United States Patent [19]

Nagarwalla et al.

[11] Patent Number: 4,757,855

[45] Date of Patent: Jul. 19, 1988

[54] METHOD AND APPARATUS FOR LOADING AND UNLOADING TOOLING FROM A FOUNDRY MACHINE

[75] Inventors: Pheroze J. Nagarwalla, Rochester Hills; Jackson E. Brown, Mt. Clemens; Kenneth E. Bellis, Rochester, all of Mich.

[73] Assignee: Roberts Corporation, Lansing, Mich.

[21] Appl. No.: 34,173

[22] Filed: Apr. 2, 1987

[51] Int. Cl.[4] ..... B22C 11/08

[52] U.S. Cl. ..... 164/19; 164/29; 164/131; 164/180; 164/200; 164/154; 164/213

[58] Field of Search ..... 164/4.1, 456, 12, 15, 164/16, 19, 20, 21, 23, 27, 28, 29, 150, 154, 180, 186, 192, 193, 200, 201, 202, 213, 228, 233, 401, 131

[56] References Cited

U.S. PATENT DOCUMENTS

| | | | |
|---|---|---|---|
| 3,096,547 | 7/1963 | Hunter et al. | 164/186 |
| 4,100,961 | 7/1978 | Goss et al. | 164/186 |
| 4,673,022 | 9/1987 | Mitzner | 164/201 |

*Primary Examiner*—Nicholas P. Godici
*Assistant Examiner*—Richard K. Seidel
*Attorney, Agent, or Firm*—Thomas K. Ziegler; Raymond J. Eifler

[57] ABSTRACT

A foundry machine for forming molds or cores from a molding material such as sand provides completely automated loading and unloading of tooling elements (24). The tool elements (24) comprising a sand magazine (36), blow plate (34), combined gassing manifold and top ejector unit (32), upper mold box (30), lower mold box (28) and bottom stool (26) are automatically transferred, in stacked, separable relationship, by tracks (40) to a vertically displaceable, work table. Vertical displacement of the work table (42) sequentially elevates the tooling elements (24) to positions within a mainframe (10) where automatically operated clamping means secure the appropriate tooling elements (24) in respective operating positions. The gassing manifold (32) includes an ejector pin assembly (274, 280) mounted therewithin.

29 Claims, 24 Drawing Sheets

FIG. 19
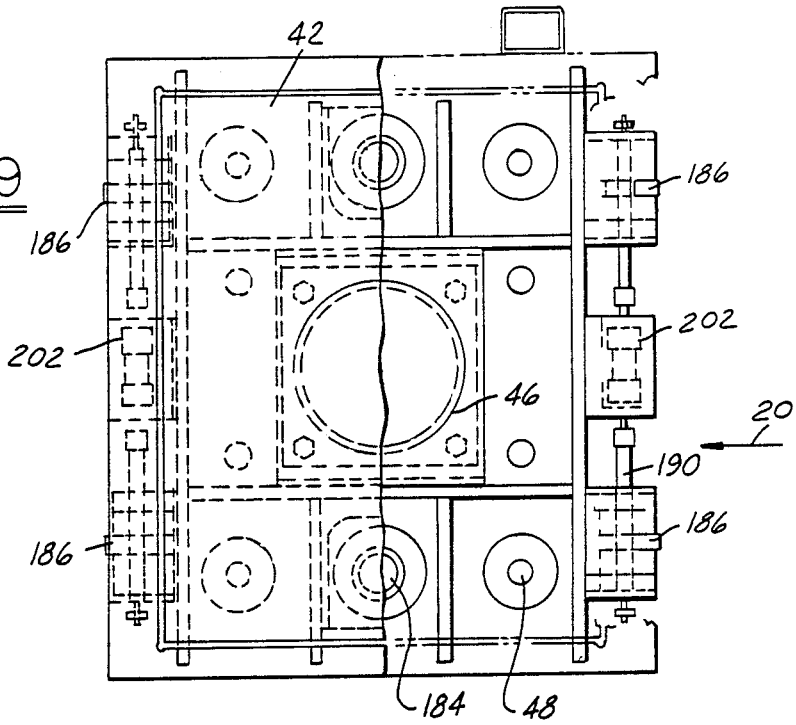
FIG. 20
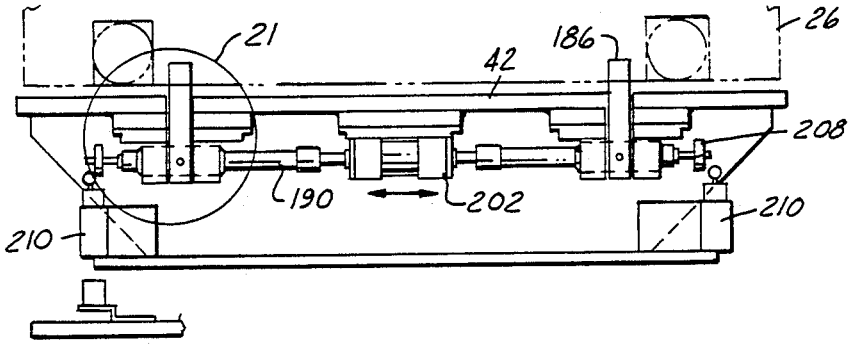
FIG. 21
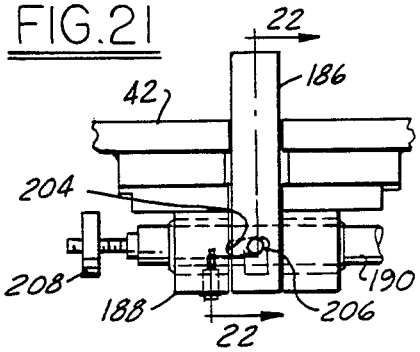
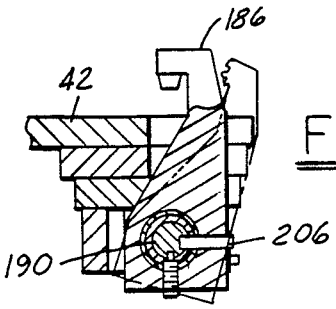
FIG. 22

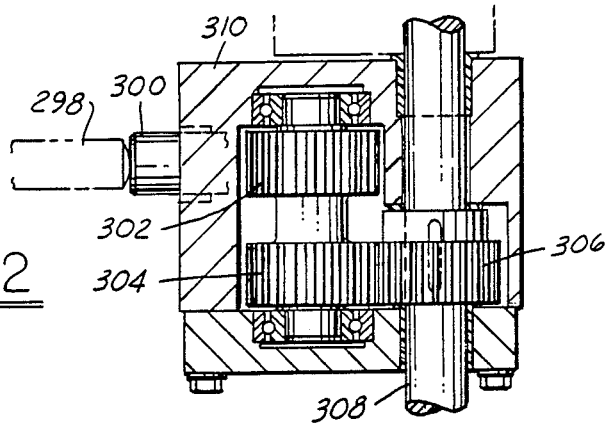
FIG.42
FIG.44
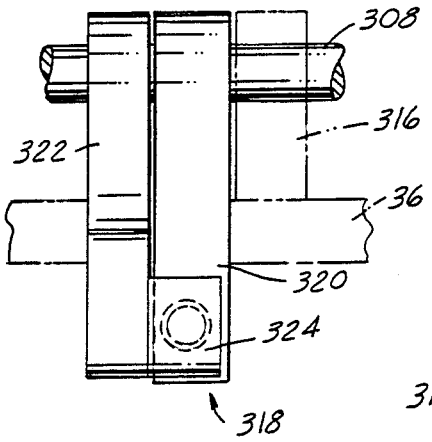
FIG.43
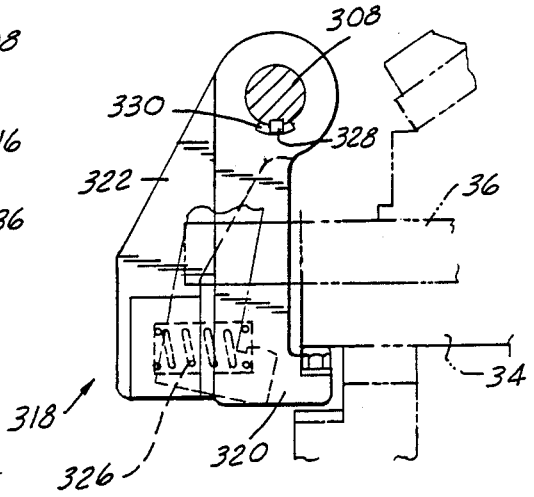

FIG.50
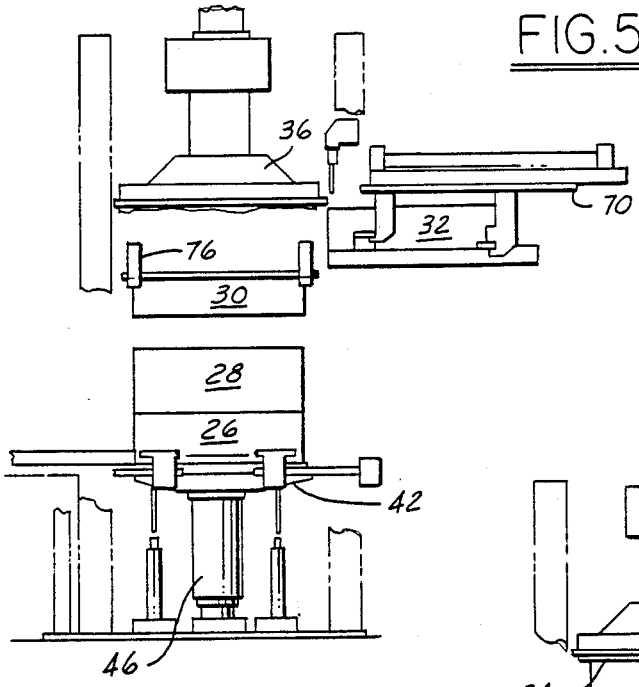
FIG.51
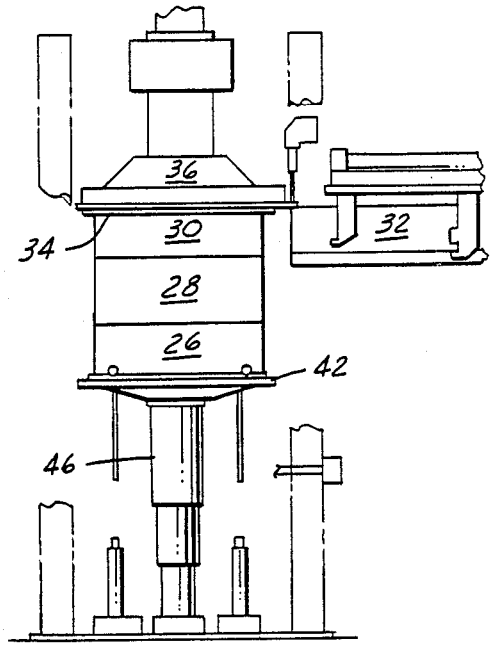
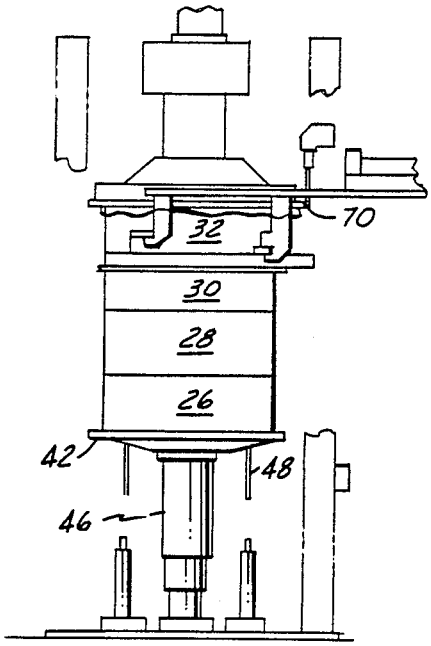
FIG.52

METHOD AND APPARATUS FOR LOADING AND UNLOADING TOOLING FROM A FOUNDRY MACHINE

This invention relates to a foundry machine for forming molds or cores by an automated process.

In foundry molding machines wherein molds or cores for use in subsequent casting operations are formed out of molding materials such as sand, it is common to place onto a vertically movable work table the upper and lower cavity-containing mold halves, known as the cope and drag, respectively. The table is movably mounted in a fixed frame, the upper portion of which contains a sand hopper, appropriate valving, and a blow head and blow plate adapted to blow sand downwardly into the mold cavity. The table is adapted to lift the stacked mold boxes into communication with the underside of the blow plate for filling or charging the mold box cavity with sand, following which the mold boxes are lowered and curing means, such as a catalyzing gas manifold, are transferred into engagement with the lowered mold boxes to inject a sand-curing gas into the mold cavity. Following this step, means are provided for vertically separating the upper and lower mold boxes, ejecting the newly-formed part and automatically conveying the part away.

An exemplary prior art patent showing such construction is U.S. Pat. No. 4,100,961 to Goss et al.

The above-mentioned prior art Goss patent describes a variety of techniques which have been employed for ejecting the finished part from the mold boxes. One of the methods involves separating the molds and then inverting the mold box which initially retained the finished part and ejecting the part downwardly from the inverted box onto a transfer device. Another technique therein described involves separating the mold boxes, moving the finished part upwardly out of the lower mold box on ejector pins, moving a fork transversely into the space between the lower mold box and temporarily elevated part, and then lowering the ejector pins to deposit the part onto the fork, which can then be transversely withdrawn. Still another disclosed technique involves separating the molds while retaining the formed part in the upper mold half, transversely moving a conveyor or fork-type device into the space beneath the downwardly-facing upper mold cavity and ejecting the part downwardly onto the conveyor for removal.

It would be highly desirable to further automate the operating cycle of a foundry machine to include automatic means for initially loading the mold boxes onto the work table and for removing them therefrom following a production run. Furthermore, associated tooling unique to a given finished part may include, in addition to the cope and drag, an underlying bottom stool containing a lower ejector mechanism, an upper ejector mechanism, a gassing manifold, a blow plate and a sand magazine. It would be highly desirable to further automate the operating cycle by providing means for automatically loading such additional associated tooling into the foundry machine, without the need for manual placement or securing of these components.

SUMMARY OF THE INVENTION

According to one aspect of the invention, the mainframe of the foundry machine is provided with a work table which supports the tooling during portions of the operating cycle and additional tooling support means which support the tooling during other portions of the cycle. Such additional tooling support means include means for separating the upper and lower mold boxes following formation of a part within the mold box cavities. A stationary tooling loading table is provided adjacent to the mainframe and work table, and includes tooling transfer means for moving the tooling to and from the additional tooling support means mounted in the mainframe. Part-removal means are also provided for removing a finished part which has been ejected from the separated molds.

According to a further aspect of the invention, the tooling is conveyed along rails on the auxiliary table and then onto aligned rails which form a portion of the additional tooling support means in the mainframe. The work table then lifts the tooling off of such mainframe rails, and these rails are swung into an inactive position where they avoid interference with the vertically moving table and tooling.

A further aspect of the invention involves the mounting of the part-removal means on the auxiliary table, and the use of the same transfer means to both load and unload the tooling from the mainframe and to remove a completed part by means of the part removal means.

Accordingly, it is an advantage of this invention to provide a fully automatic method and apparatus for initially loading tooling onto the work table and for removing such tooling therefrom after the completion of a production run.

It is another advantage of this invention to provide a method and apparatus in which the tooling which is automatically loaded and unloaded from the work table may optionally include, in addition to the cope and rag, one or more of the sand magazine, blow plate, gassing manifold, top ejector means and bottom ejector means.

Another advantage of this invention is the use of only a single transfer mechanism to propel both the tool-loading and unloading means and the part removal means, thereby saving expense, maintenance and space.

BRIEF DESCRIPTION OF THE DRAWINGS

FIG. 19 is a plan view, partly broken away, of the work table, viewed in the direction of arrows 19—19 of FIG. 16.

FIG. 20 is a right side view of the tooling clamping mechanism, viewed in the direction of arrow 20 of FIG. 19.

FIG. 21 is an enlarged view of the clamping mechanism shown within circle 21 of FIG. 20.

FIG. 22 is a sectional view in the direction of arrows 22—22 of FIG. 21.

FIG. 42 is a sectional plan view in the direction of arrows 42—42 of FIG. 41.

FIG. 43 is an enlarged front view of a blow plate clamp, viewed in the direction of arrows 43—43 of FIG. 38.

FIG. 44 is a side view of the clamp of FIG. 43.

FIGS. 48-53 are simplified front views showing successive stages of the operating cycle of the apparatus.

DETAILED DESCRIPTION OF THE INVENTION

In the following description, the invention has been described as applied to the making of cores. However, as will be understood by those skilled in the art, the features of the invention are also applicable to the making of molds. Hence, reference to cores is for convenience and is not to be interpreted as limiting. Similarly, the terms "core boxes" and "mold boxes" may be used interchangeably herein.

Figure 1:
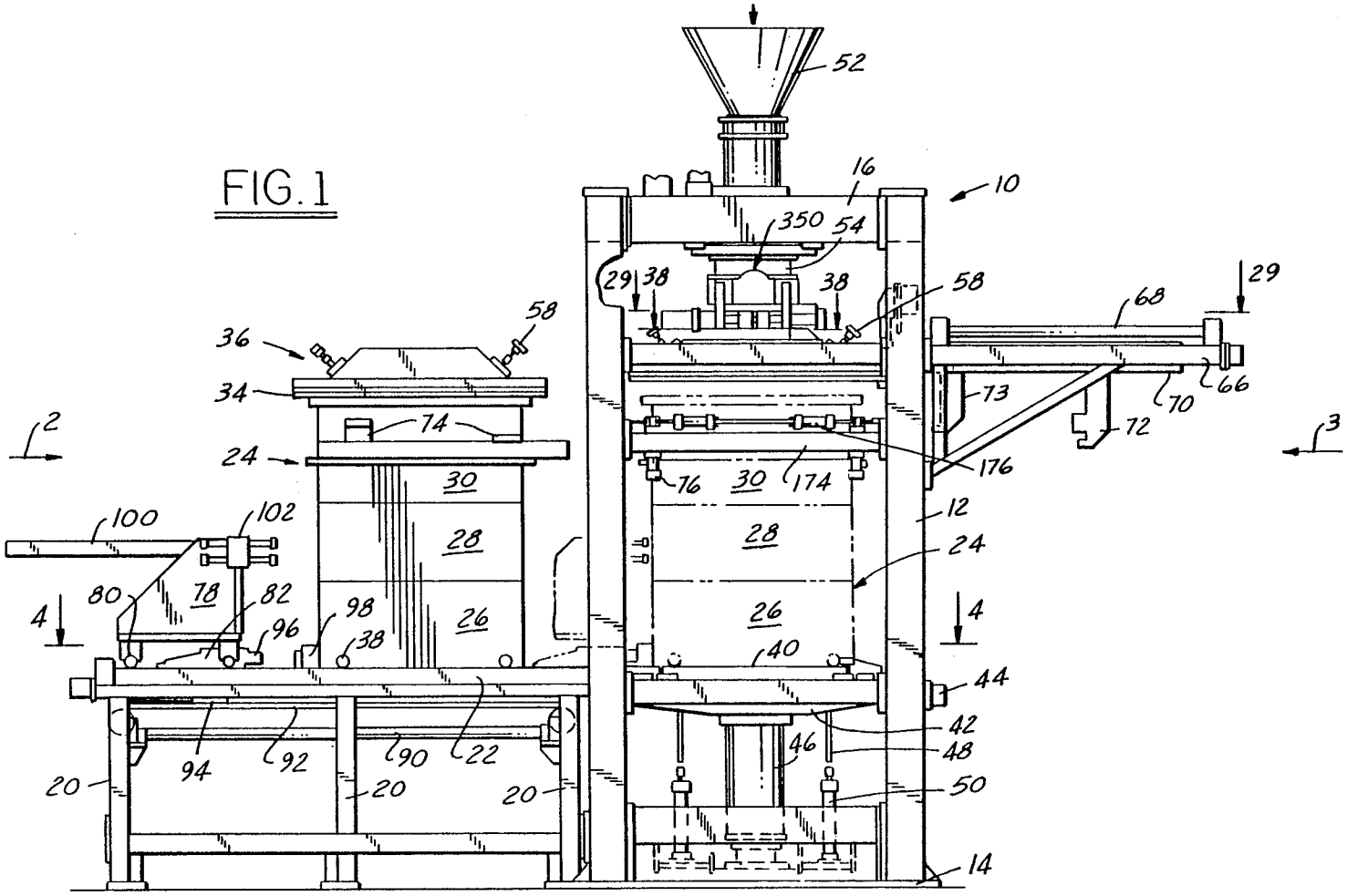
FIG. 1 is a front view of the foundry machine of the present invention, showing the tooling in solid lines on the loading table and in phantom lines on the work table.
Figure 3:
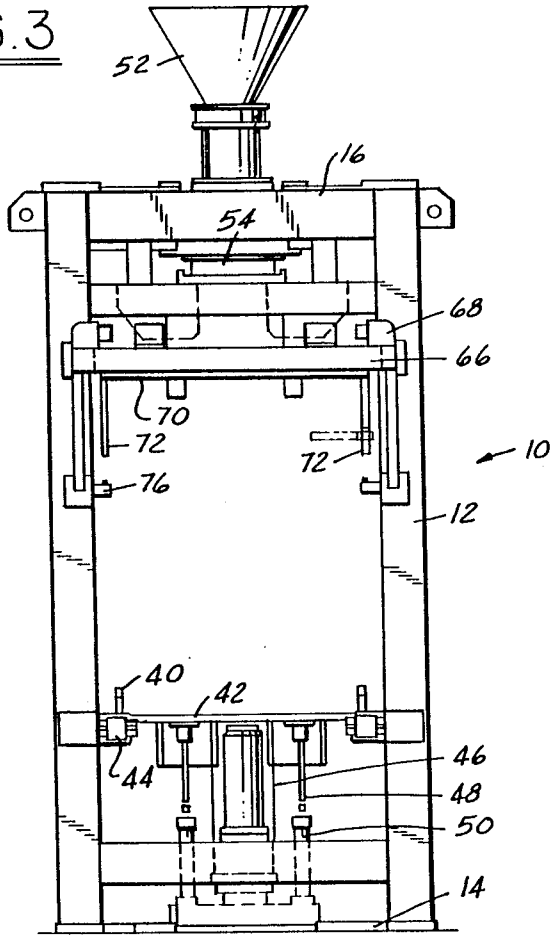
FIG. 3 is a right side view in the direction of arrow 3 of FIG. 1.
Figure 2:
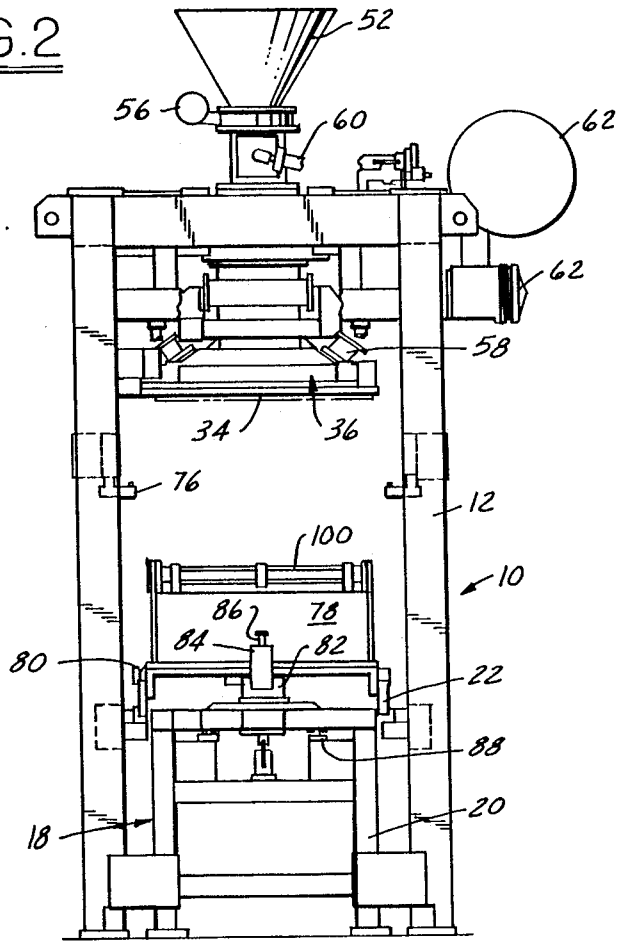
FIG. 2 is a left side view in the direction of arrow 2 of FIG. 1.

Referring to FIGS. 1-3 of the drawings, which show the overall arrangement of the principal components of the invention, the improved core-making machine of this invention comprises a mainframe 10 which includes four posts 12 interconnecting base plate 14 and horizontal upper beams 16.

To one side of mainframe 10 there is mounted tool-loading and pick-off table 18, which comprises vertical legs 20 supporting horizontal rails 22 which in turn support and guide tooling 24. Tooling 24 comprises a series of stacked components including bottom stool 26, lower core box or drag 28, upper core box or cope 30, gassing manifold and ejector plate 32, blow plate 34 and sand magazine 36. Drag 28 and cope 30 contain cavities (not illustrated) for the core which is to be formed. These elements of the tooling are stacked on top of each other as a single unit when the tooling is initially installed on the tool-loading and pick-off table 18. Alternatively, gassing manifold and ejector plate 32, blow plate 34 and sand magazine 36 can be left in place within mainframe 10 following a previous operation, and not loaded along with the mold boxes and stool.

Bottom stool 26 is provided with wheels 38 that permit the tooling to roll along rails 22 and onto pivotable rails 40 which are aligned with rails 22 and pivotally secured to mainframe 10. Rails 40 are adapted to pivot out of the path of vertically moving clamping table 42 by means of hydraulic rotary actuators 44. FIG. 1 illustrates tooling 24 in its initial position on tool-loading and pick-up table 18, and also shows in phantom the tooling in position on rails 40 of mainframe 10 after it has been automatically moved into such position by the mechanism to be described below.

Also illustrated in FIGS. 1 and 3 is the telescoping table clamp cylinder 46 which functions to raise and lower tool clamping table 42. The lower end of cylinder 46 is fixed to base 14, while the extendable outer cylinder sleeve is secured to the underside of table 42. Adjacent to table lifting cylinder 46 there is mounted a series of lower ejector pin actuators 48 which are actuated by ejector cylinders 50 to eject the core from lower core box 28 following formation and curing of the core.

Still referring to FIGS. 1 and 2, sand is loaded into the system by means of sand hopper 52 which interconnects with blow plate 34 and sand magazine 36 by means of blow sleeve 54. The flow of sand, which generally includes a binder, is controlled by a butterfly valve (not illustrated) and hopper valve actuator 56, while air is permitted to escape during the sand charging operation by means of sand magazine exhaust vent valves 58 and exhaust valve 60. Blowing air is supplied from pressurized air tank 62 under the control of blow valve control 64.

FIGS. 1 and 3 also illustrate a mechanism for transferring the gassing manifold and ejector plate 32 between its operating and stand-by positions. A support frame 66 mounted on mainframe 10 carries a pair of hydraulic cylinders 68 which are connected to a transfer carriage 70 from which depend hanger brackets 72 and 73 which engage retainer brackets 74 on gassing manifold and ejector plate 32. Further details of the construction and operation of this transfer mechanism will be discussed below.

FIGS. 2 and 3 also illustrate a series of cope hangers 76 which are pivotally mounted on frame crossmember 174 under the control of hydraulic cylinders 176 and which function to support the upper core box or cope during certain phases of the machine cycle.

FIGS. 1 and 2 also illustrate a trolley and carriage mechanism which functions both to transfer tooling 24 into and out of the work station of mainframe 10 and also to pick off and remove the completed core from the tooling. Trolley 78 has wheels 80 which ride along tracks 22. Trolley 78 engages a horizontally movable carriage 82 for movement therewith by means of latch 84 and latch pin 86. Carriage 82 is supported for horizontal movement by means of guide supports 88, while movement of the carriage and trolley is controlled by a hydraulic transfer cylinder 90 operating through cable 92 and its connection 94 to the carriage.

Figure 4:
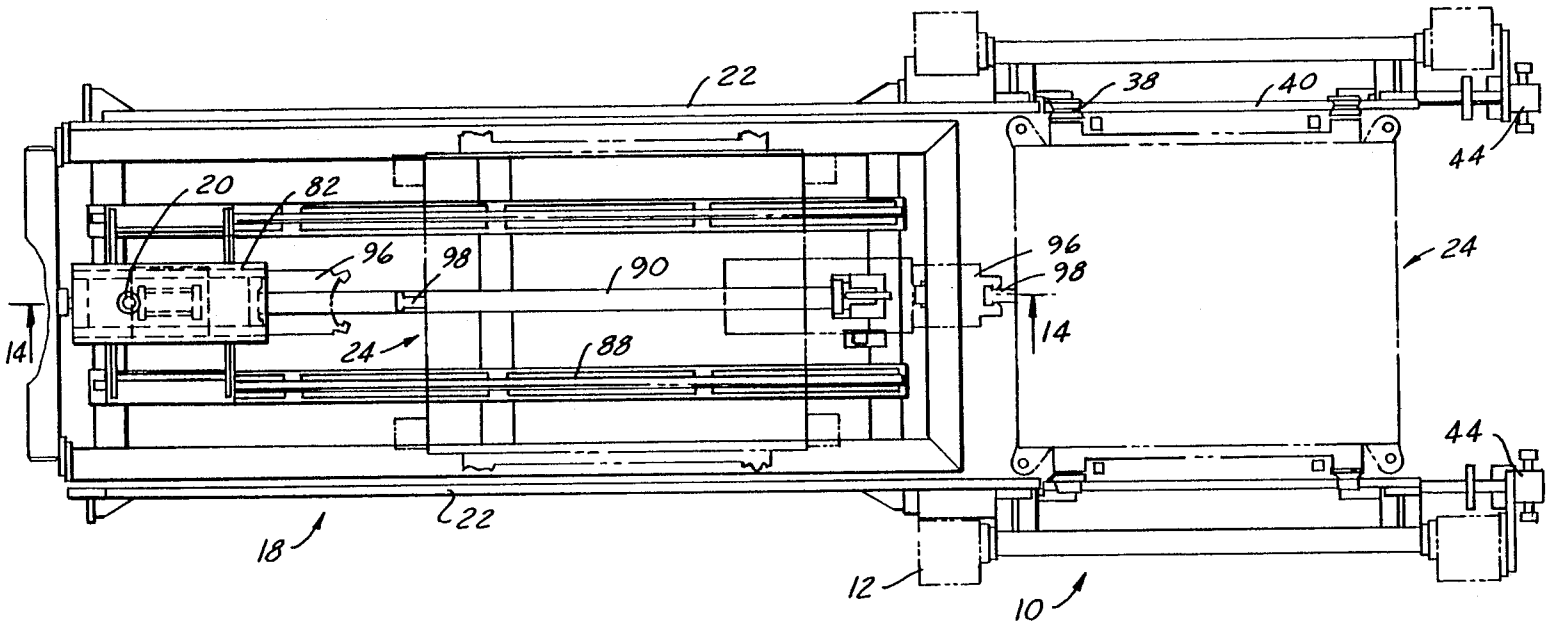
FIG. 4 is a plan view, partly in phantom, in the direction of arrows 4—4 of FIG. 1.

The plan view of FIG. 4, which shows tooling 24 in phantom (in both of its positions) and omits trolley 78 for clarity, shows gripper jaws 96 which form a portion of carriage 82 and which are adapted to releasably engage and grip coupling 98 which forms a portion of bottom stool 26 of tooling 24. The actuation means for jaws 96 will be further described below.

FIGS. 1 and 2 also illustrate pick-off unit 100 which is pivotally mounted on trolley 78 under the control of hydraulic rotary actuator 102. As will be further explained below, pick-off unit 100 may be pivoted from its illustrated retracted position to an extended condition wherein it removes a completed and ejected core from the core boxes and transports the core out of the work station within mainframe 10.

Figure 5:
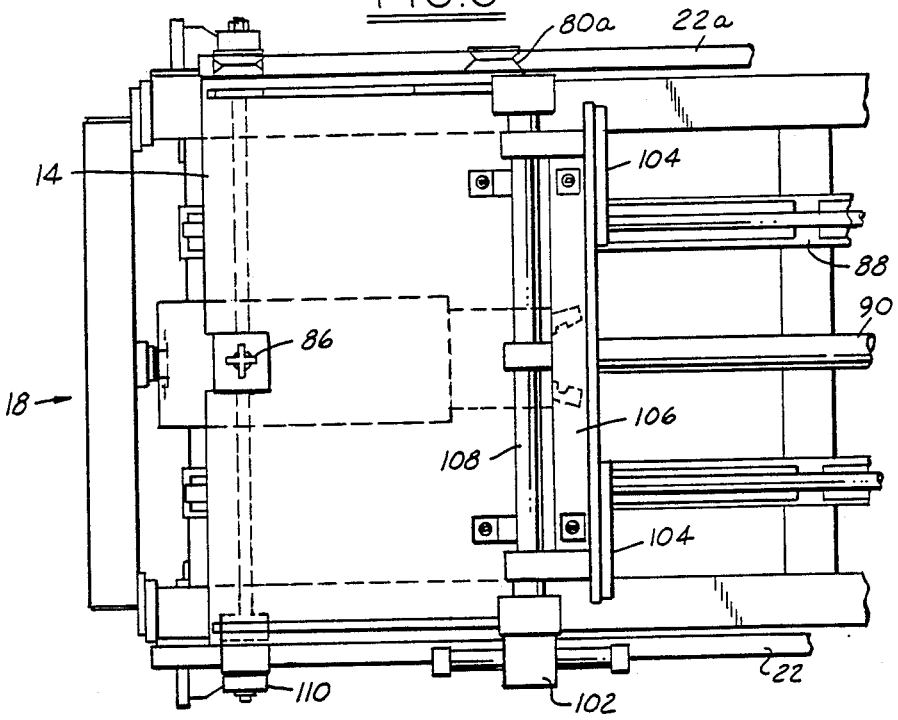
FIG. 5 is a fragmentary plan view of a portion of the trolley and loading table.
Figure 6:
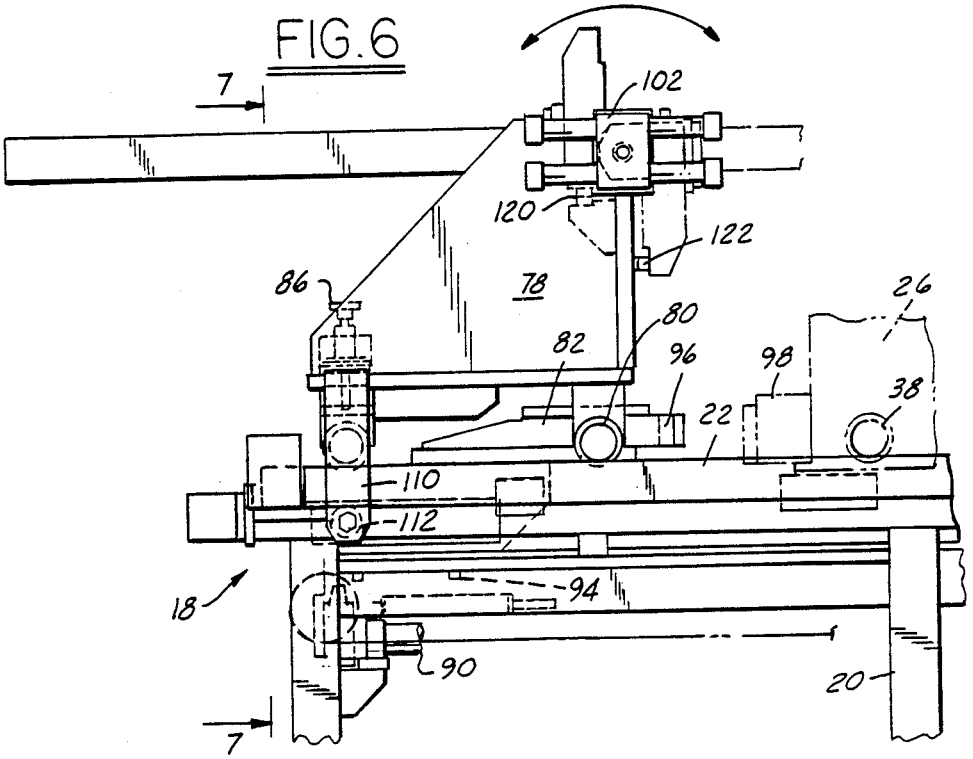
FIG. 6 is a front view of the apparatus shown in FIG. 5.

FIGS. 5 and 6 show further details of trolley 78 and pick-off unit 100. In the fragmentary plan view of FIG. 5, the fingers of the pick-off unit have been omitted for clarity. The fingers are adapted to be secured to mounting plates 104, which are in turn secured to bracket 106 which is clamped to pick-off finger pivot shaft 108. Pivot shaft 108 is selectively rotatable through approximately 180 degrees under the control of rotary actuator 102.

As shown in the fragmentary front elevational view of FIG. 6, trolley 78 is provided with downwardly extending hold-down brackets 110, on the lower end of which are secured rollers 112 which engage the lower face of rails 22. These rollers stabilize the trolley and prevent it from tipping, particularly when the pick-off fingers are supporting a completed core.

Figure 7:
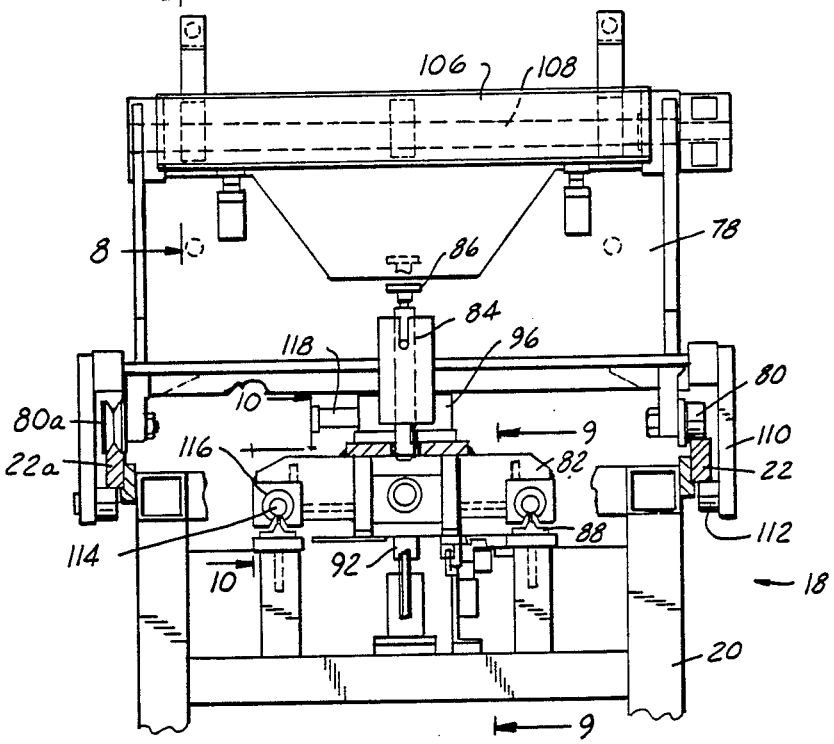
FIG. 7 is a left side view in the direction of arrows 7—7 of FIG. 6.

FIG. 7 shows additional details of the carriage and trolley. Previously mentioned carriage guide supports 88 support longitudinally extending carriage guide rods 114. Carriage 82 is provided with bushings 116 which engage and slidably grip guide rods 114. In this manner, carriage 82 is supported and guided during its longitudinal movement toward and away from mainframe 10.

FIG. 7 also illustrates hydraulic cylinder 118 which controls the opening and closing of gripper jaws 96 on carriage 82. As shown on the left side of FIG. 7, and in contrast to the configuration of the corresponding elements on the righthand side of the figure, rail **22*a* and trolley wheel 80*a*** have cooperating V-shaped profiles to maintain the trolley in its desired lateral position as it moves along the rails.

Figure 8:
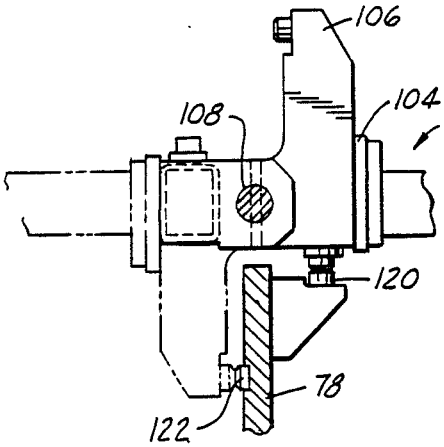
FIG. 8 is an enlarged fragmentary view in the direction of arrows 8—8 of FIG. 7, showing the pick-off finger stops.

FIG. 8 shows in greater detail portions of the pick-off unit 100 of FIGS. 5–7. Specifically, FIG. 8 illustrates the pick-off finger mounting arrangement and stops 120 and 122 which limit the pivotal movement in the withdrawn and extended positions, respectively.

Figure 9:
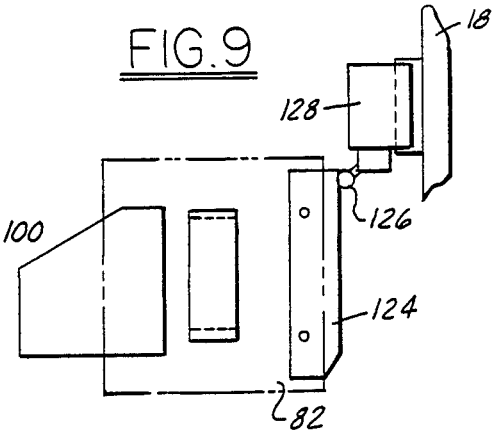
FIG. 9 is an enlarged fragmentary view in the direction of arrows 9—9 of FIG. 7, showing a position sensor for the carriage.
Figure 10:
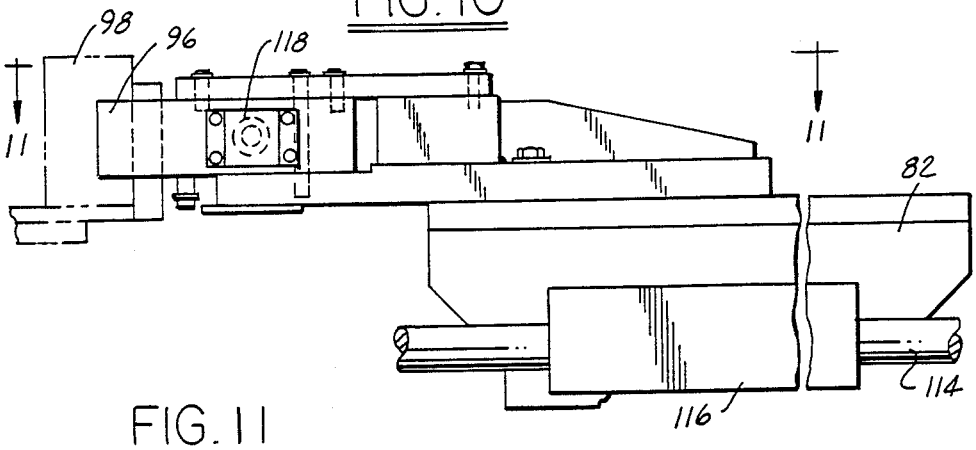
FIG. 10 is an enlarged view of the carriage and gripper jaws, viewed in the direction of arrows 10—10 of FIG. 7.
Figure 11:
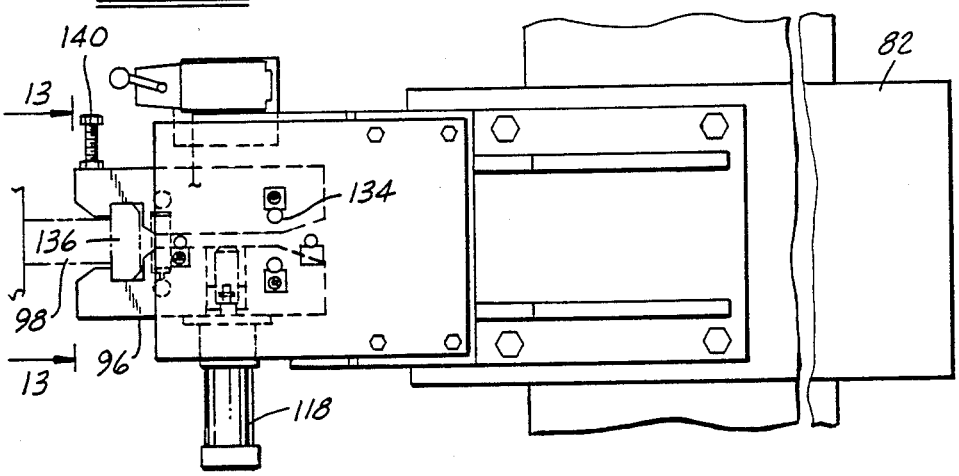
FIG. 11 is a plan view in the direction of arrows 11—11 of FIG. 10.

FIG. 9 illustrates a position-sensing mechanism whereby, when trolley 78 and carriage 82 are in their fully withdrawn or stand-by position, contact plate 124 on the carriage trips actuator 126 of limit switch 128 to indicate such condition to the control mechanism.

Figure 12:
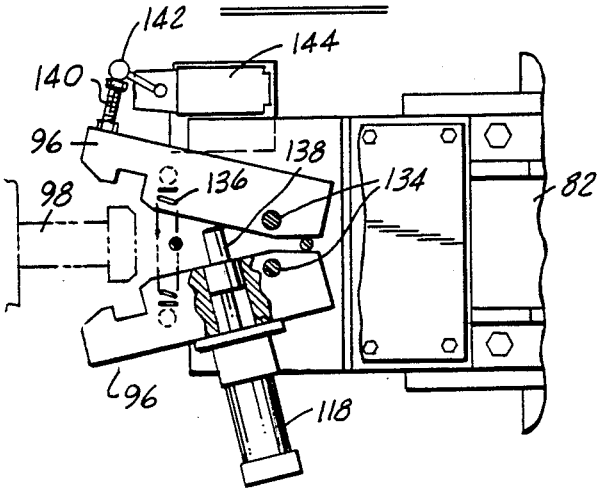
FIG. 12 is an enlarged plan view of the gripper jaws of FIG. 11, shown in their open position.
Figure 13:
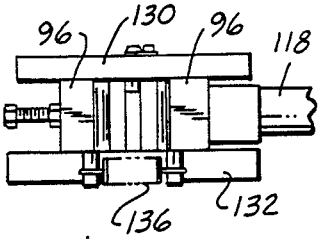
FIG. 13 is a side elevational view of the gripper jaws, viewed in the direction of arrows 13—13 of FIG. 11.

FIGS. 10–13 illustrate details of the gripper jaw assembly by which carriage 82 engages and grips tooling 24 for longitudinal movement toward or away from mainframe 10. Gripper jaws 96 are pivotally mounted between upper and lower plates 130, 132, respectively, on pivot pins 134. The two jaw elements are biased toward each other by tension spring 136. Actuation of hydraulic cylinder 118, which is mounted on one of the jaws, extends cylinder rod 138 into engagement with the opposite jaw member, forcing the jaws apart to their released position, as illustrated in FIG. 12. In such released condition, contact pin 140 on one of the jaw elements engages actuator arm 142 of limit switch 144, thereby indicating that jaws 96 have disengaged from tooling coupling member 98.

Figure 14:
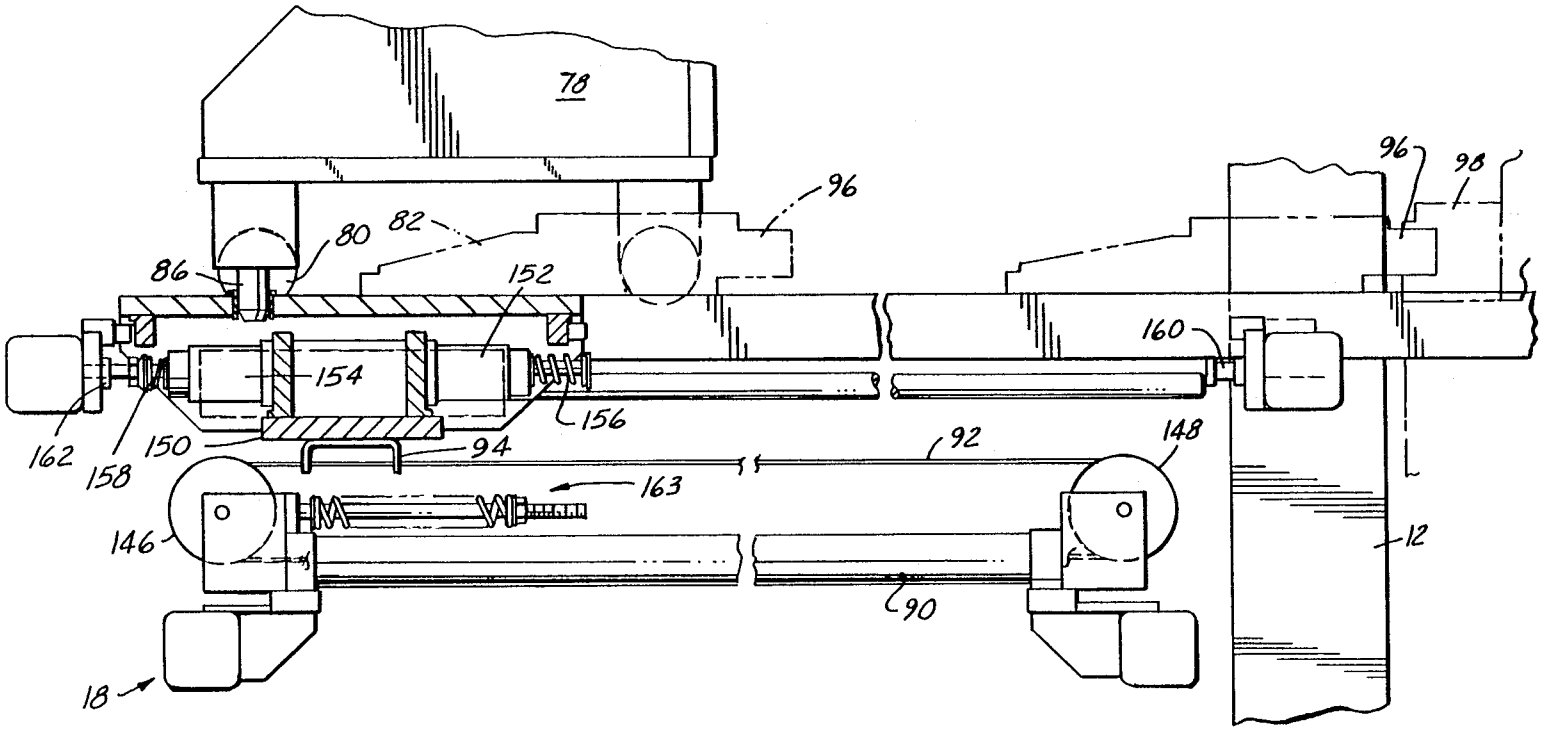
FIG. 14 is an enlarged front view of the carriage transfer mechanism.

FIG. 14 illustrates additional details of the drive mechanism for trolley 78 and carriage 82. As previously explained, transfer cylinder 90 is secured to the tool-loading and pick-off table 18. The transfer cable is looped around a pair of pulleys 146, 148. Cable 92 is fixed to the piston (unillustrated) of transfer cylinder 90, this connection being internal of the cylinder. Thus, actuation of the cylinder causes the cable to move linearly about pulleys 146, 148, carrying with it carriage connector 94 and connector bracket 150. Bracket 150 has a pair of shock absorbers 152, 154 secured to it, these in turn being provided with spring-loaded plungers 156, 158, respectively. These shock absorbers function to cushion the end of the stroke of carriage 82 as it engages adjustable stops 160 or 162 at the respective limits of carriage travel. Cable tensioner 163 is an adjustable biasing means to apply continuous leftward force on pulley 146 to keep cable 92 free of slack.

Figure 15:
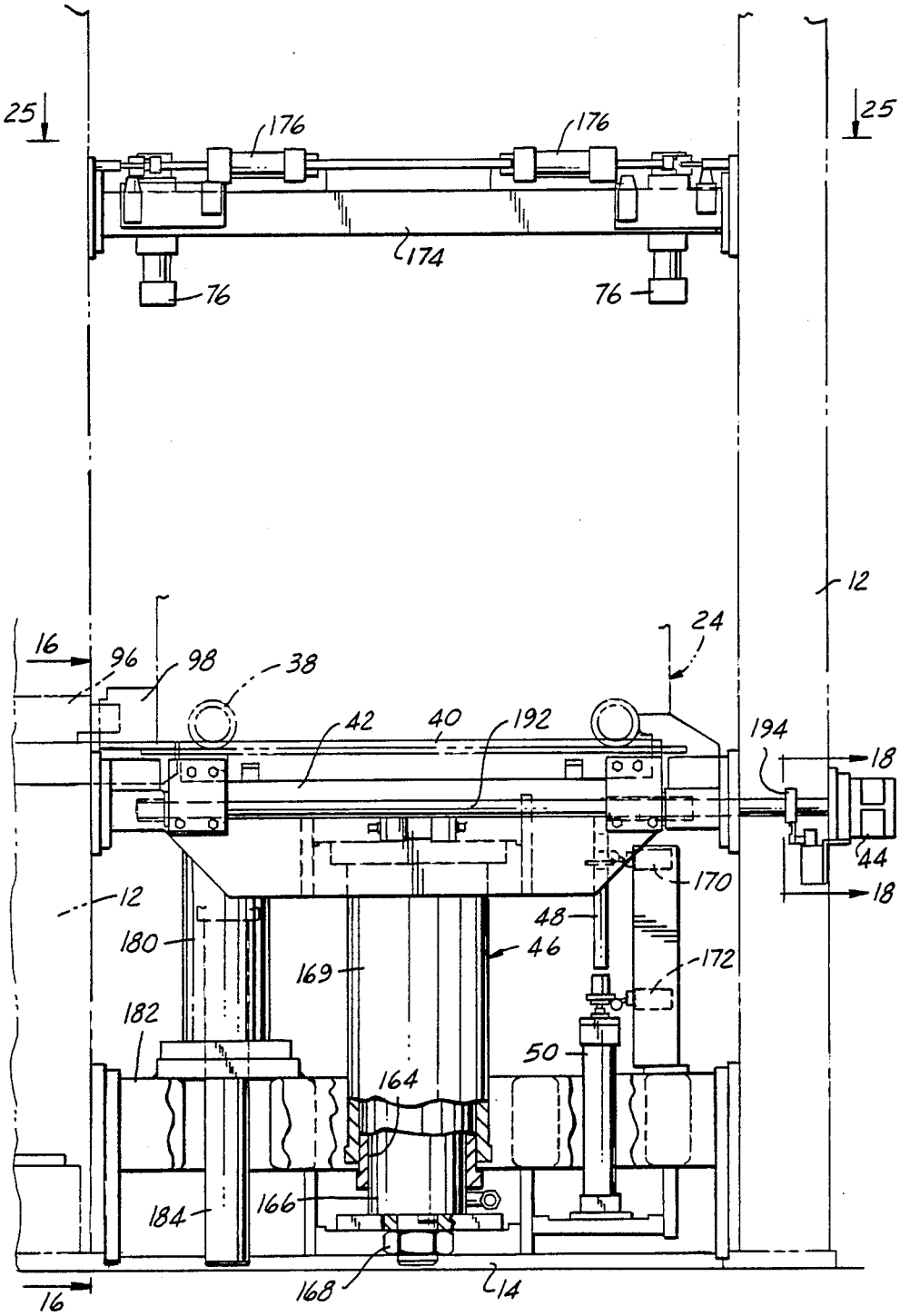
FIG. 15 is a front view of the work table and related structure.

FIG. 15 is an enlarged fragmentary view showing details of the clamping table 42 and clamping cylinder 46. As previously stated, clamping cylinder 46 is of telescoping construction, including an extendable hollow cylinder rod 164 which telescopes over fixes inner cylinder rod 166 which, in turn, is secured to mainframe base 14 by nut 168. Outer cylinder sleeve 169, in turn, telescopes over rod 164 so that the potential stroke of cylinder 46 is almost twice the stroke of a conventional cylinder. The telescoping construction of cylinder 46 permits a more compact assembly, without the need for a pit beneath the floor to accommodate the required stroke of a conventional cylinder. A suitable telescoping cylinder for this purpose is manufactured by Precision Hydraulics & Engineering, Inc., of Signal Hill, Calif. The vertical position of lower ejector pin actuators 48 is sensed by upper and lower limit switches 170, 172, respectively, which are tripped by flanges on lower ejector pin actuators 48. Ejector pin actuators hang or are spring-biased to their downward position illustrated in FIGS. 15 and 16, but they are adapted to be displaced upwardly when cylinders 50 are extended. As will be understood by those skilled in the art, bottom stool 26 is provided with a conventional ejector plate mechanism (not illustrated) adapted to be engaged and actuated by ejector pin actuators 48 so that ejector pins 390 (see FIG. 53) may enter aligned holes in drag 28 to eject the completed core from the drag cavity.

The upper portion of FIG. 15 shows a mainframe crossmember 174 on which cope hangers 76 are mounted for pivotal movement under the influence of hydraulic cylinders 176. Cylinders 176 cause hangers 76 to swing from a stand-by position, which provides clearance for vertical passage of tooling 24, and an extended position in which they support the upper core box or cope. A pair of limit switches 178 sense the two pivotal positions of cope hanger 76.

Figure 16:
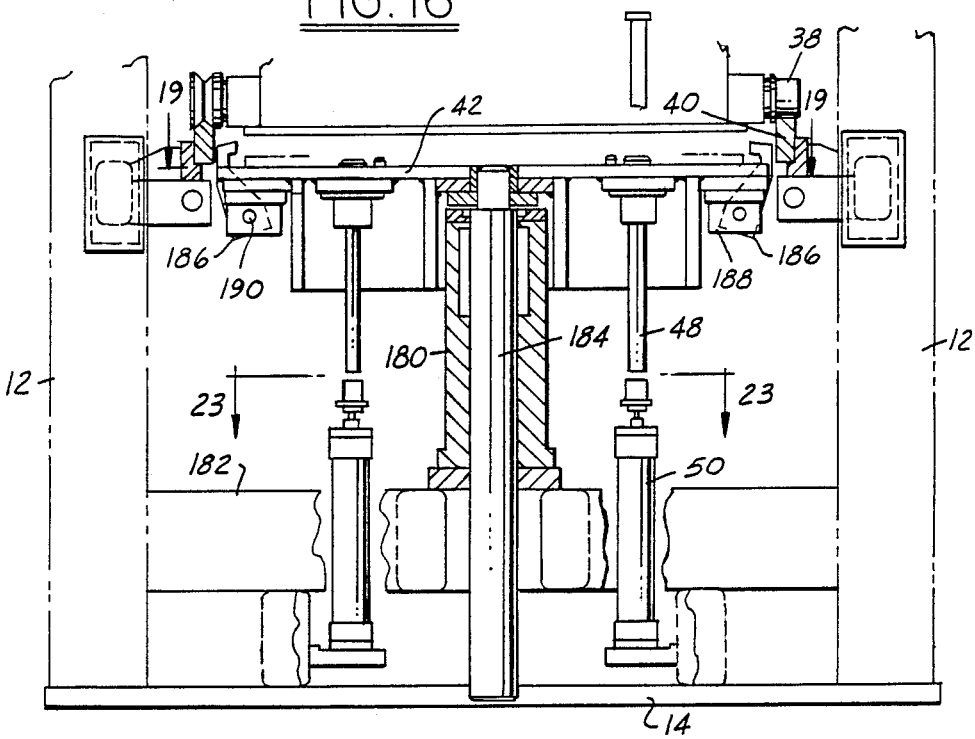
FIG. 16 is a side view of the work table, viewed in the direction of arrows 16—16 of FIG. 15.

FIG. 16 illustrates additional details of the clamping table and related structure. Guidance and stabilization of clamping table 42 throughout its vertical movement is provided by guide rod bushings 180 which are secured to frame crossmember 182. These bushings receive guide rods 184 which are secured to the underside of clamping table 42. Also shown in FIG. 16 are two of the four clamping units 186 which are pivotally secured to brackets 188 and caused to pivot by shafts 190. As will be further explained below, clamping units 186 function to clamp tooling 24 to clamping table 42.

Figure 17:
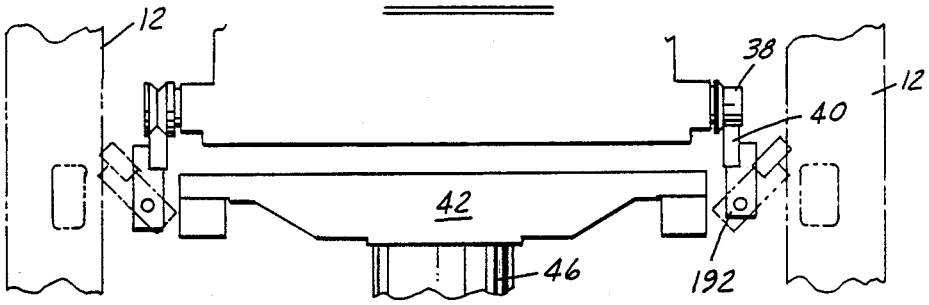
FIG. 17 is a fragmentary view, similar to FIG. 16, showing the alternative positions of the rails.
Figure 18:
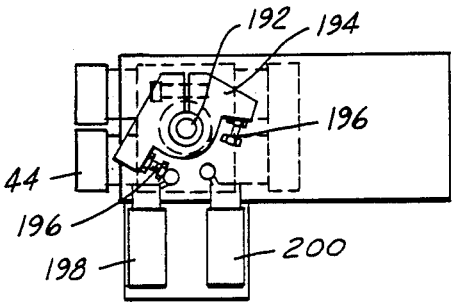
FIG. 18 is a side view of the rail actuator mechanism, viewed in the direction of arrows 18—18 of FIG. 15.

Referring now to FIGS. 17 and 18, there is illustrated the mechanism for causing pivotal rails 40 to swing out of the path of the tooling. The rails are mounted for pivotal movement with pivot shafts 192. Hydraulic rotary actuators 44 cause rotational movement of shafts 192 by means of a rack and pinion arrangement which is not illustrated but which may be similar to that illustrated in FIG. 41. Brackets 194 are similarly clamped to pivot shafts 192 so that actuation causes simultaneous pivotal movement of brackets 194, shaft 192 and rails 40. Contact screws 196 are mounted on brackets 194 for engagement with rail position-indicating limit switches 198 and 200.

FIGS. 19–22 show the clamping mechanism for clamping tooling 24 to table 42. As shown in FIGS. 19–20 cylinders 202 have shaft extensions 190 which simultaneously stroke outwardly upon actuation of the cylinder. Each shaft has a camming slot 204 which is skewed relative to the shaft axis, as seen in FIG. 21. Follower pin 206 in clamp 186 rides in slot 204, whereby longitudinal stroking of shaft 190 by cylinder 202 causes the sides of slot 204 to cam follower pin 206 so as to pivot clamp 186 into or out of its clamping position. In the solid line clamping position shown in FIG. 22, clamp 186 engages a flange on bottom stool 26 to retain tooling 24 in position on table 42. Shaft extensions 190 carry actuators 208 which trip limit switches 210 to indicate the condition of clamps 186.

Figure 23:
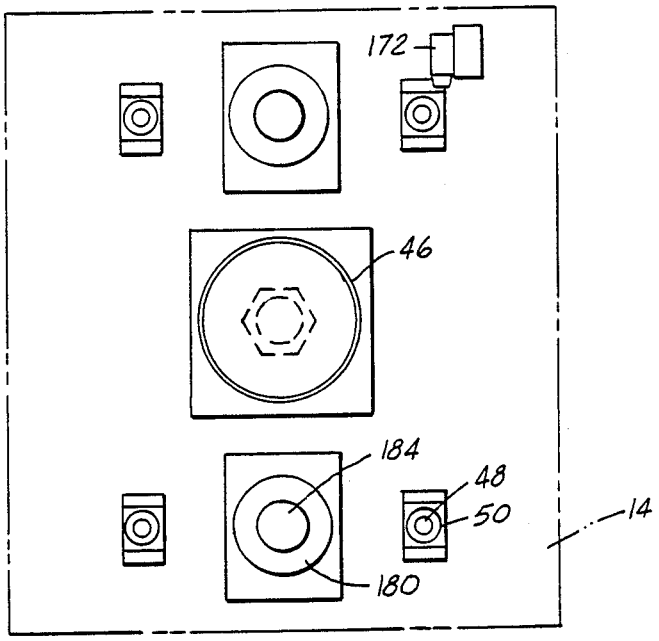
FIG. 23 is a plan view of the work table supporting structure, viewed in the direction of arrows 23—23 of FIG. 16.

FIG. 23 is a sectional view of the previously described structure beneath clamping table 42, showing table clamp cylinder 46, guide rods 184, lower ejector pin actuators 48 and a representative lower limit switch 172.

Figure 24:
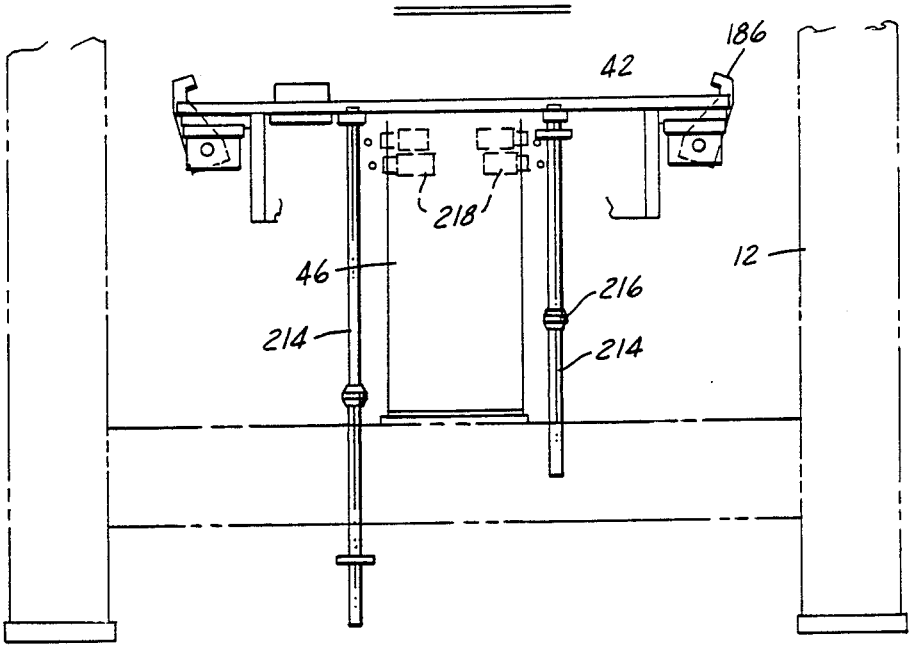
FIG. 24 is a fragmentary view, similar to FIG. 16, showing the table position-indicating means.
Figure 25:
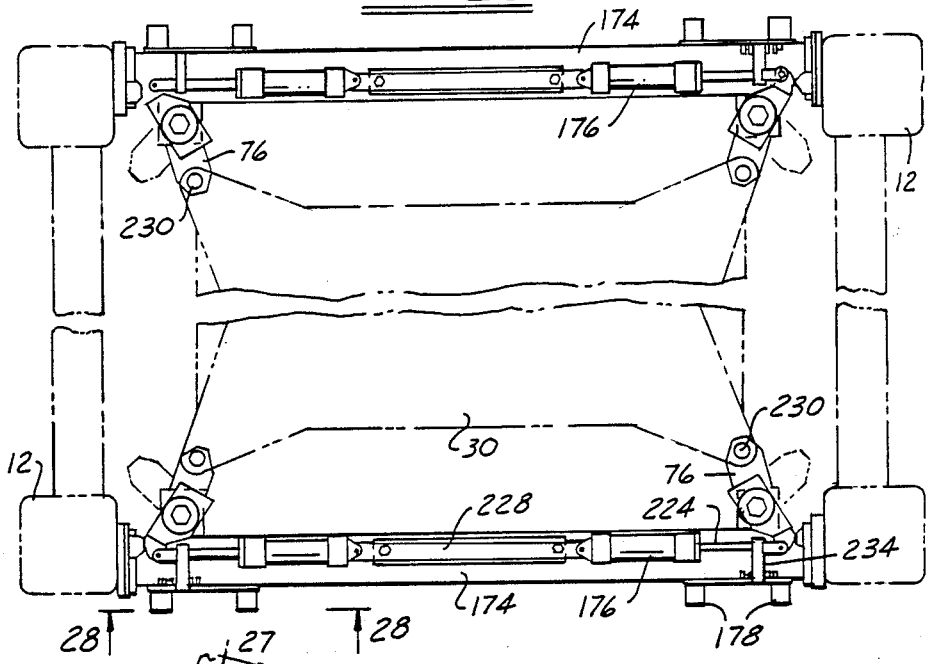
FIG. 25 is a plan view of the cope hanger mechanism, viewed in the direction of arrows 25—25 of FIG. 15.
Figure 26:
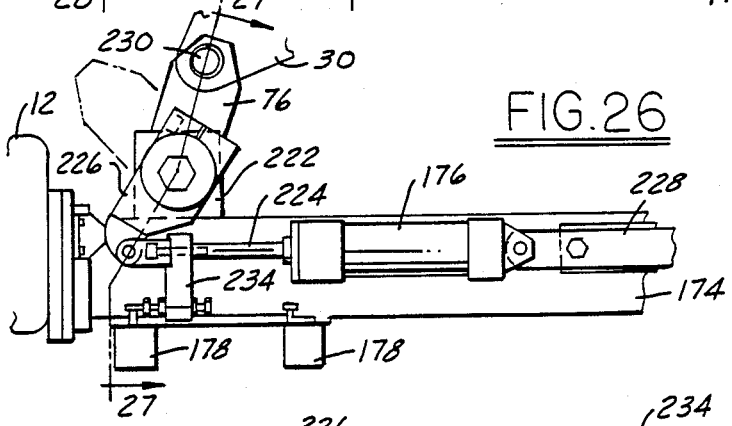
FIG. 26 is an enlarged plan view detail of one of the cope hangers of FIG. 25.

FIG. 24 illustrates the mechanism for sensing the vertical elevation of clamping table 42. A pair of vertical rods 214 extend downwardly from the underside of the table, each rod having an enlarged cam portion 216 adapted to trip limit switches 218 to thereby indicate when the table has reached a predetermined position.

Figure 27:
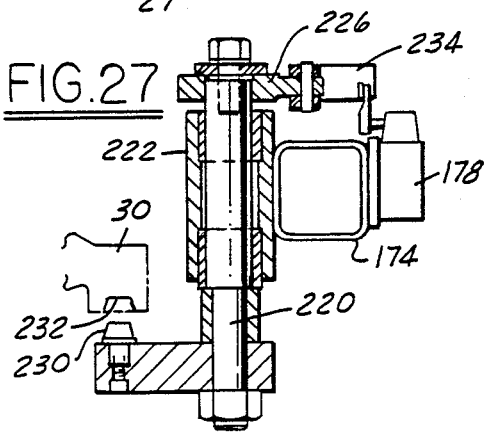
FIG. 27 is a sectional elevation viewed in the direction of arrows 27—27 of FIG. 26.
Figure 28:
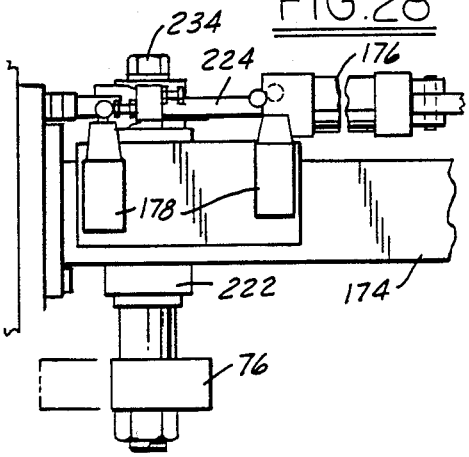
FIG. 28 is a front view of the cope hanger of FIG. 27.

FIGS. 25–28 illustrate, in further detail, the cope hanger construction previously described in relation to FIG. 15. Cope 30 is shown in phantom in the plan view of FIG. 25 and in the fragmentary cross-sectional elevation of FIG. 27. Each of cope hangers 76 is mounted for pivotal movement with a pivot shaft 220 which is rotatably received within bracket 222 secured to frame crossmember 174. Cylinder rod 224 of cope hanger actuating cylinder 176 is connected to an actuating lever 226 which is secured to pivot shaft 220 for rotation therewith. Thus, linear movement of cylinder rod 224 causes pivotal movement of lever 226, shaft 220 and cope hanger 76. Brackets 228 provide support for the opposite end of each of hydraulic cylinders 176. As best shown in FIG. 27, each of cope hangers 76 has an upwardly tapering cope locating pin 230 which is adapted to seat in a downwardly opening socket 232 at each of the four corners of cope 30. In this manner, cope hangers 76 function to both locate and support cope 30 during the appropriate portion of the cycle. A limit switch actuator 234 on each of cylinder rods 224 functions to trip the appropriate limit switch 178 to indicate the condition and position of cope hangers 76.

Figure 29:
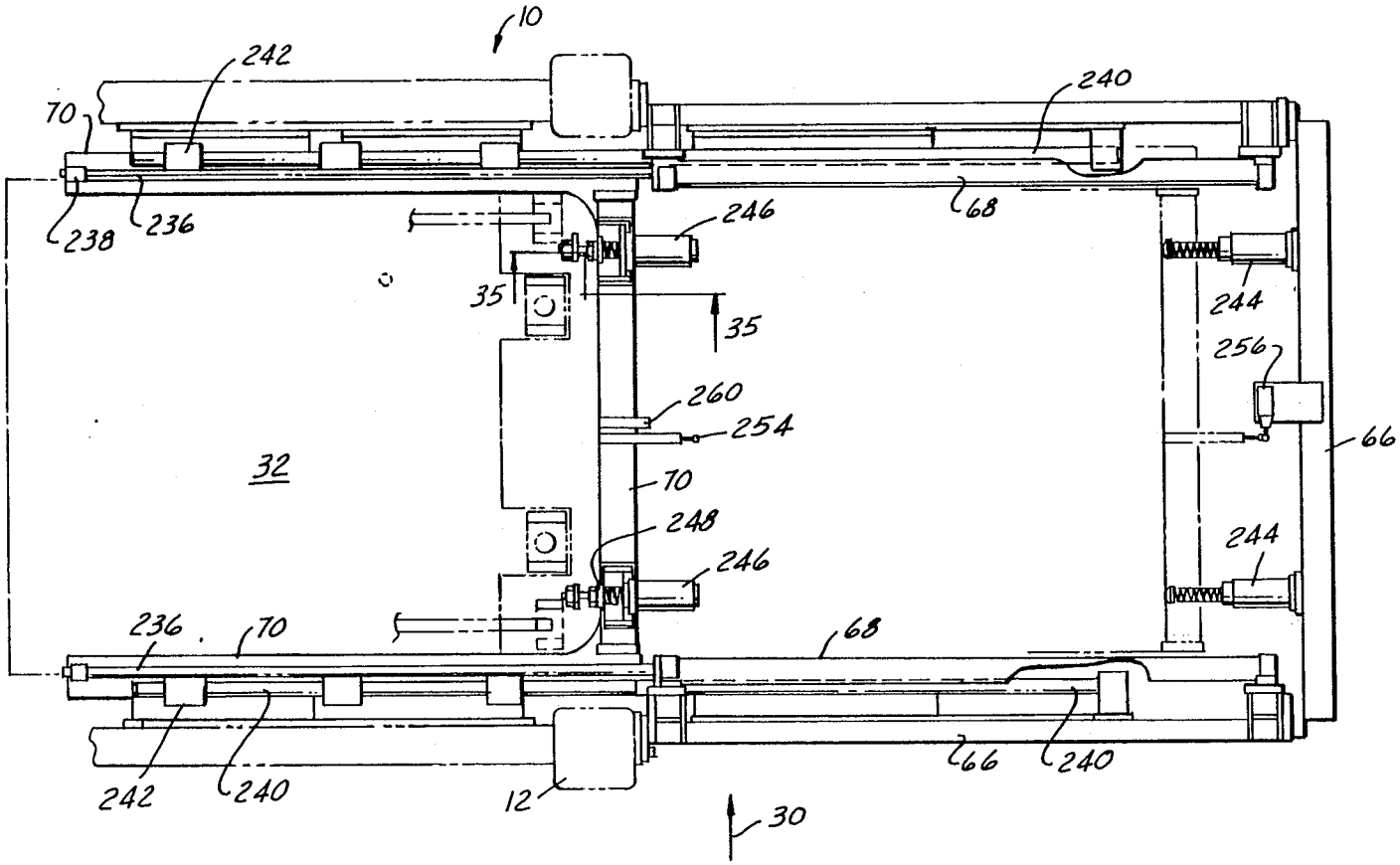
FIG. 29 is a plan view of the gassing manifold transfer mechanism, viewed in the direction of arrows 29—29 of FIG. 1.
Figure 30:
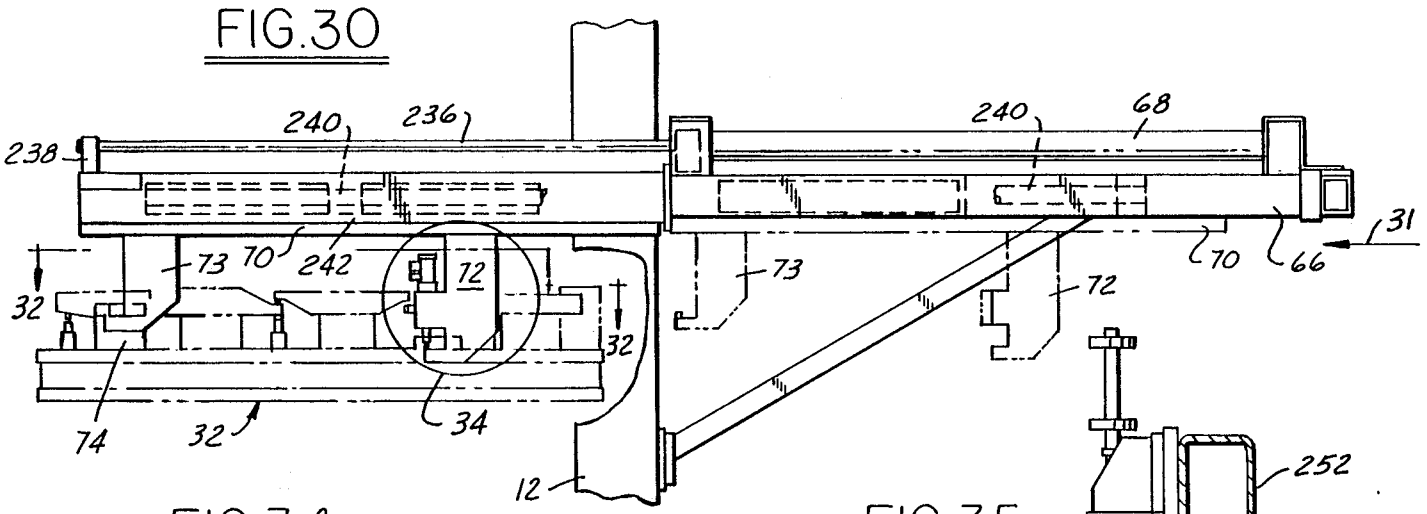
FIG. 30 is a front view of the apparatus of FIG. 29.

FIGS. 29 and 30 show further details of the gassing manifold and ejector plate transfer mechanism generally shown in FIG. 1. As previously explained, a gassing manifold transfer support frame 66 is secured to one end of mainframe 10. Hydraulic cylinder 68, which functions to traverse gassing manifold transfer carriage 70 between its active and stand-by positions, has a cylinder rod 236 which is secured to a bracket 238 on carriage 70. In FIG. 30, carriage 70 is shown in its operative position at the left side of the figure, whereas the stand-by position is shown in phantom at the right side of the figure. Carriage 70 is supported during its traverse by means of guide rods 240, which are mounted on mainframe 10 and gassing manifold transfer support frame 66, and by guide rod bushings 242 on carriage 70 (see FIG. 31 for further illustration of the guide rods and bushings).

As shown in FIG. 29, a pair of shock absorbers 244 is mounted on frame 66 to cushion the end of the stroke of gassing manifold transfer carriage 70 as it reaches the end of its stroke toward its stand-by position. Similarly, another pair of shock absorbers 246 is mounted on carriage 70 itself (see FIGS. 29 and 35). When the carriage reaches the end of its stroke toward its operative position, the spring-loaded plungers of shock absorbers 246 engage stop members 248 which are carried by brackets 250 mounted on mainframe member 252.

Figure 31:
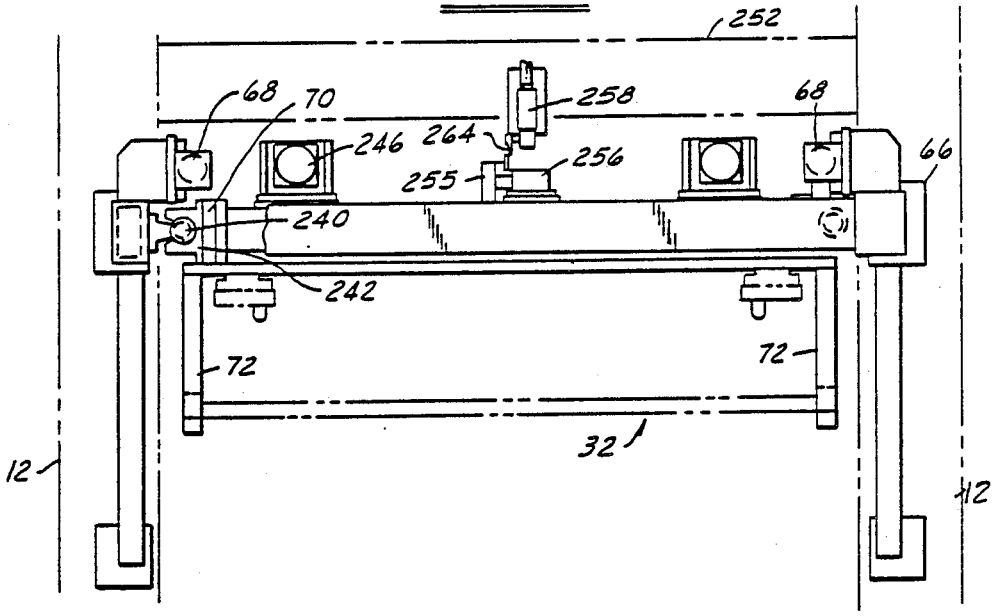
FIG. 31 is a right side view in the direction of arrow 31 of FIG. 30.

As best shown in FIGS. 29 and 31, limit switches provide a signal when carriage 70 has reached its respective positions. Specifically, an actuator 254 on carriage 70 trips limit switch 256 on support frame 66 when the carriage reaches its stand-by position, whereas limit switch 258 on mainframe member 252 is positioned to be tripped by actuator 260 on carriage 70 when the carriage reaches its operative position.

FIGS. 30 and 31 further show two pairs of gassing manifold hanger brackets 72, 73 which are mounted on carriage 70 and which engage retainer brackets 74 on gassing manifold and ejector plate 32, as will be further described below.

Figure 32:
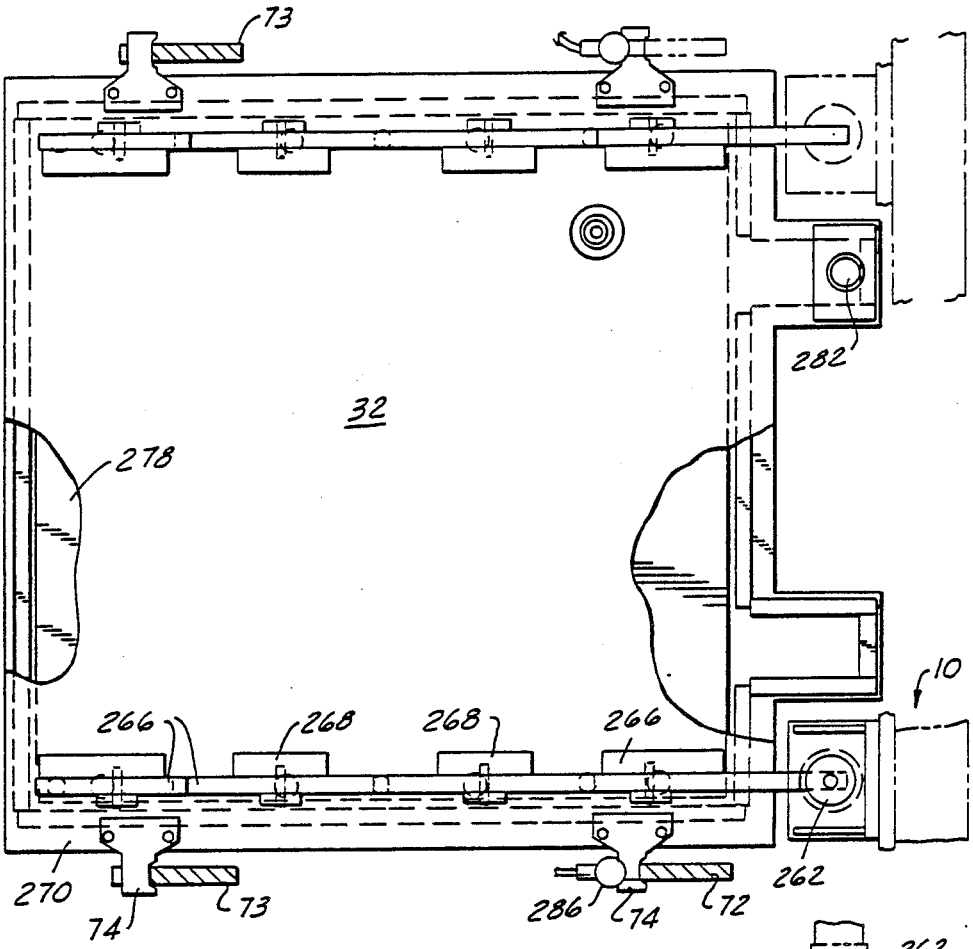
FIG. 32 is a plan view, partly broken away, of the gassing manifold, viewed in the direction of arrows 32—32 of FIG. 30.
Figure 33:
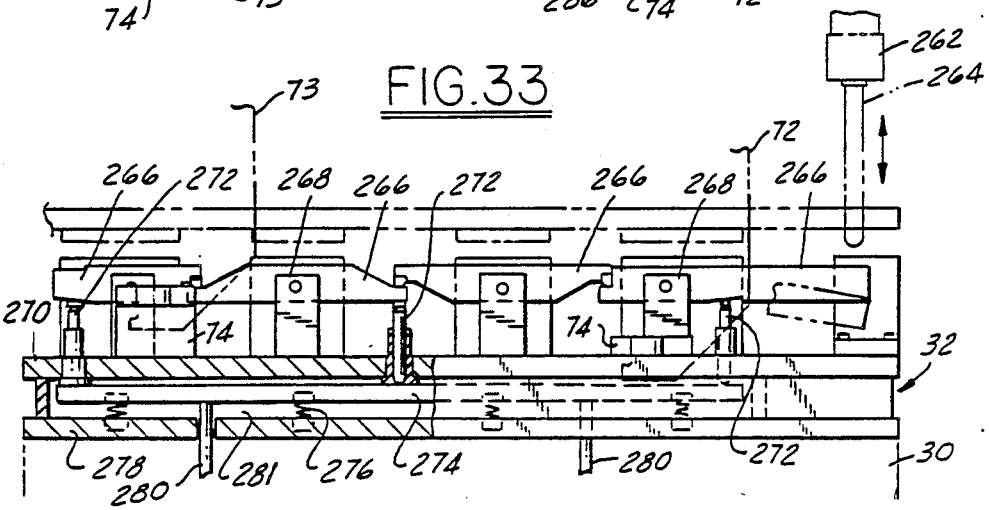
FIG. 33 is a front view partly broken away, of the gassing manifold and top ejector plate of FIG. 32.

FIGS. 32 and 33 illustrate the actuating mechanism for the upper ejector pins. A pair of hydraulic cylinders 262 is secured to a portion of mainframe 10. Output rods 264 of the cylinders extend downwardly into selective engagement with the first of the series of interengaging rocker arms 266, each of which is pivotally mounted on a bracket 268 secured to top plate 270 of gassing manifold and ejector plate 32.

As best shown in FIG. 33, downward extension of cylinder rod 264 brings it into engagement with the righthand rocker arm 266, causing such rocker arm to pivot clockwise and to force the righthand pushrod 272 downward through an opening in top plate 270 and into engagement with ejector pin plate 274. This rocking movement of righthand rocker arm 266 causes similar rocking action by each of the other interengaged rocker arms, forcing the other pushrods downward into engagement with ejector pin plate 274. Plate 274 is normally biased upwardly by compression springs 276 held between plate 274 and gassing manifold bottom plate 278. A plurality of ejector pins 280 extend downwardly from their connection to ejector pin plate 274 and through aligned openings provided in upper core box or cope 30 located immediately beneath gassing manifold 32.

A plurality of parting line pins (not illustrated) are secured to the underside of ejector pin plate 274 and extend downwardly into engagement with the top of drag 28 when the mold boxes are closed and in raised position against gassing manifold bottom plate 278. These parting line pins prevent downward deflection of ejector pin plate 274 until the mold boxes have separated from each other, thereby preventing damaging premature pressure of ejector pins 280 on the newly-formed core within the mold cavity.

Top and bottom plates 270, 278, respectively, define a manifold chamber 281. The access openings for pushrods 272 are provided with guide bushings and suitable sealing means to substantially prevent gas leakage therethrough.

FIG. 32 also illustrates one of a pair of gas pipe connections 282 which supply catalyzing gas to the interior of gassing manifold 32, as will be further discussed below.

Figure 34:
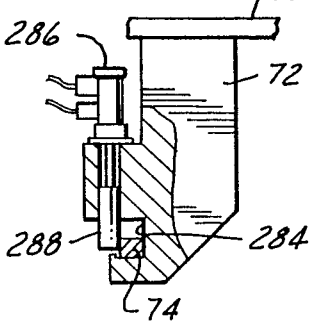
FIG. 34 is an enlarged view of the clamping mechanism within the circle 34 of FIG. 30.

FIG. 34 shows an enlarged detail of gassing manifold hanger bracket 72. Bracket 72 has a cut-out portion 284 which is adapted to receive a portion retainer bracket 74 on gassing manifold and ejector plate 32. When these elements have engaged, hydraulic cylinder 286 is actuated to extend cylinder rod 288 to clamp gassing manifold retainer bracket 74 within hanger bracket 72. Similarly, retraction of cylinder rod 288 permits separation of gassing manifold and ejector plate 32 from hanger bracket 72.

Figure 35:
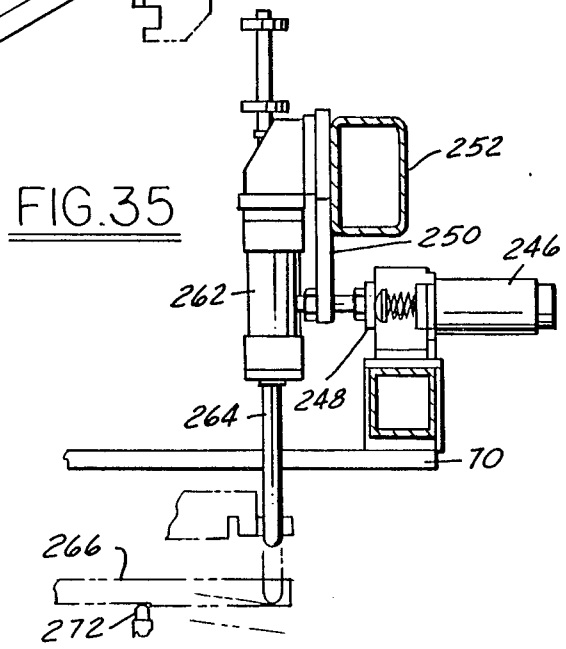
FIG. 35 is a front view of the top ejector pin actuator, viewed in the direction of arrows 35—35 of FIG. 29.

FIG. 35, a portion of which has previously been described, shows the manner in which upper ejector pin hydraulic cylinder 262 is secured to mainframe member 252.

Figure 37:
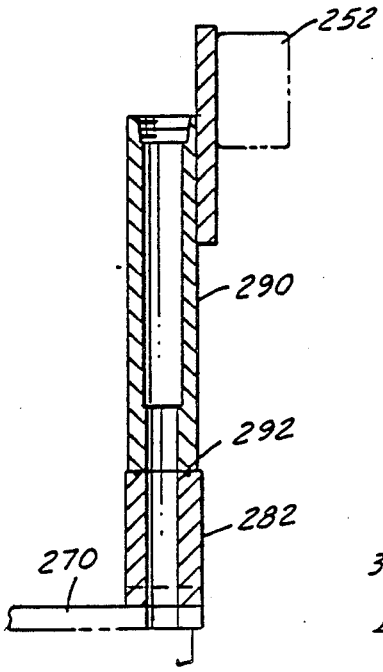
FIG. 37 is a sectional elevation viewed in the direction of arrows 37—37 of FIG. 36.
Figure 36:
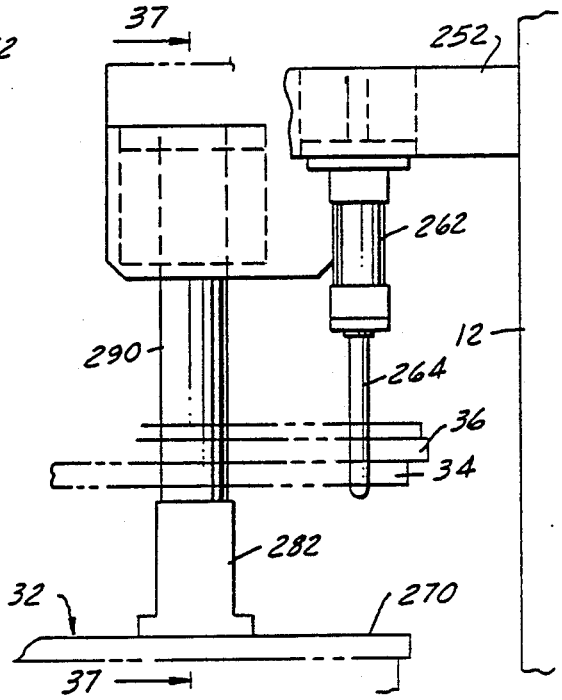
FIG. 36 is a front view of the gas connections for the gassing manifold.

FIGS. 36 and 37, in addition to showing the previously described hydraulic cylinder 262 which actuates the upper ejector pins, further show the connections for supplying catalyzing gas to gassing manifold and ejector plate 32. As also illustrated in FIG. 32, gas pipe connection 282 is fixed to top plate 270 of the gassing manifold and ejector plate 32. At the proper point in the operating cycle, the upper opening of connection 282 is moved upwardly into abutting and sealed connection with a fixed gas supply pipe 290 which is secured to mainframe crossmember 252. As shown in FIG. 37, an O-ring 286 is provided to seal this abutting connection. The upper end of supply pipe 290 is connected to a source of catalyzing gas (unillustrated). At the proper time in the operating cycle, gas is caused to flow through pipe 290 and connection 282 into gassing manifold chamber 281 (see FIG. 33) and from such chamber through the clearance gaps surrounding ejector pins 280 in bottom plate 278 and into aligned channels in cope 30 leading to the formed part within the mold box cavity.

Figure 38:
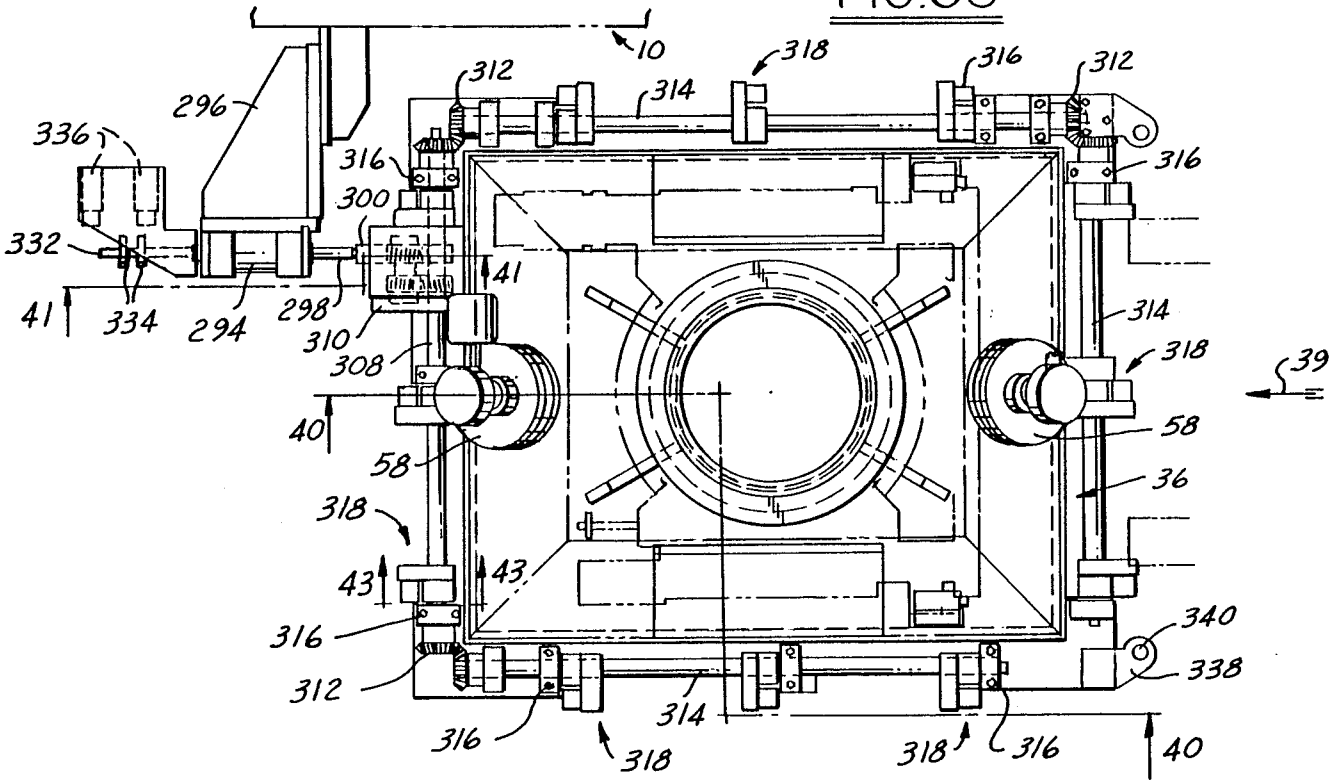
FIG. 38 is a plan view of the sand magazine, viewed in the direction of arrows 38—38 of FIG. 1.

FIG. 38 shows additional details of sand magazine 36 and the clamping mechanism by which blow plate 34 is clamped to the lower side of the sand magazine. Additional details of the clamping mechanism are shown in FIGS. 41–44, which should be referred to in connection with the following description.

The blow plate clamping mechanism includes a pair of clamping cylinders 294 which are secured to main frame 10 by means of bracket 296. Each of cylinders 294 has a cylinder rod 298 which abuts the end of a cooperating rack gear 300. Both rack gears engage a pinion gear 302 which rotates in conjunction with adjacent pinion gear 304 on the same shaft. Gear 304 in turn meshes with spur gear 306 which is keyed to shaft 308. Rack gears 300, pinion gears 302 and 304, spur gear 306 and shaft 308 are all mounted within gear housing 310 secured to sand magazine 36. At each of end of shaft 308 there is a bevel gear set 312 which provides driving engagement with similar bevel gears on three additional clamping shafts 314.

Thus, shaft 308 and the three additional shafts 314 are arrayed around four sides of sand magazine 36 and are rotatably mounted in brackets 316 secured to the sand magazine.

FIGS. 43 and 44 illustrate the manner in which a typical clamping unit 318 clamps blow plate 34 to sand magazine 36. Each clamping unit comprises a clamping arm 320 and an actuating arm 322, each keyed to shaft 308. A lateral projection 324 on arm 322 overlaps arm 320, and a compression spring 326 retained between these overlapping portions continuously biases the arms away from each other. While actuating arm 322 is keyed to shaft 308 for direct pivotal movement therewith, it can be seen in FIG. 43 that key 328 for clamping arm 320 is placed in an oversized slot 330 in arm 320. This arrangement permits a limited amount of lost motion between the rotation of shaft 310 and the pivoting movement of clamping arm 320. Such lost motion feature avoids overstressing of the clamping and clamped elements and eliminates the need for close control of tolerances on all of the clamping members around the four sides of the blow plate, as would otherwise be necessary to assure simultaneous and even clamping pressure at all clamping locations. Thus, once blow plate 34 is securely clamped against sand magazine 36 at a particular clamping unit, further rotation of shaft 310 and actuating arm 322 is still possible, without accompanying rotation of clamping arm 320. Nevertheless, firm clamping pressure will continue to be exerted because of compression spring 326.

Figure 41:
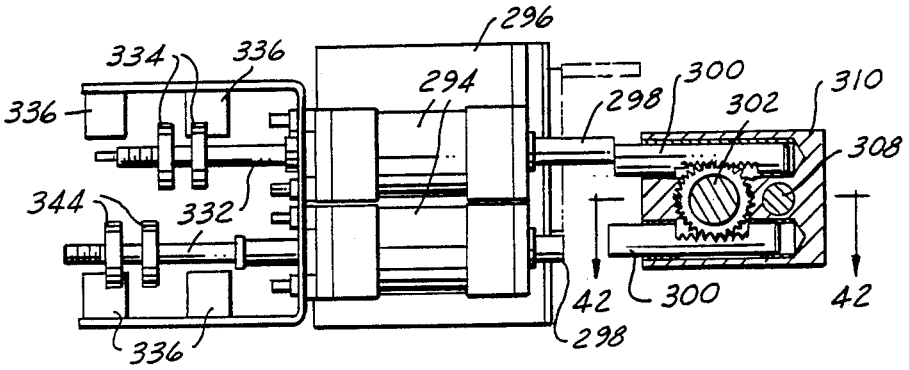
FIG. 41 is a front view, partly in section, of the blow plate clamping actuator mechanism, viewed in the direction of arrows 41—41 of FIG. 38.

FIGS. 38 and 41 also illustrate a limit switch arrangement which signals the condition of the blow plate clamping system. Each of hydraulic cylinders 294 has a cylinder rod extension 332 provided with a pair of limit switch actuators 334 which engage one or the other of a pair of limit switches 336. Thus, these limit switches generate a signal which indicates whether the clamping mechanism is in either its clamped or released condition.

Figure 40:
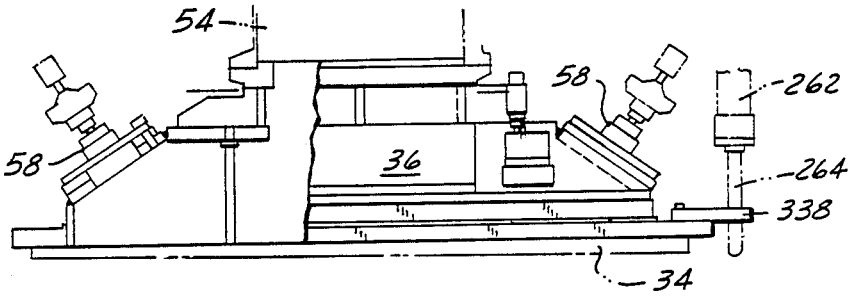
FIG. 40 is a front view, partly in section, of the sand magazine of FIG. 38.

FIGS. 38 and 40 also illustrate a pair of guide brackets 338 secured to the corners of sand magazine 36. These brackets are provided with guide holes 340 through which cylinder rods 264 of the upper ejector pin actuating mechanism project (see also FIGS. 35–36).

Figure 39:
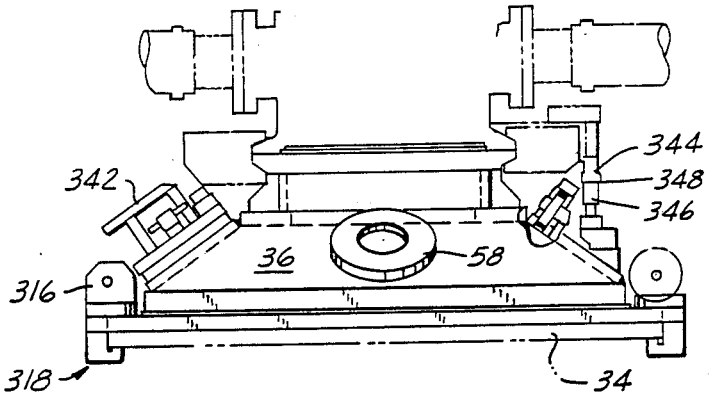
FIG. 39 is a right side view in the direction of arrow 39 of FIG. 38.

FIG. 39 also shows a handle and locking device 342 for a sand magazine clean-out door. Also shown is a pneumatic line 344 fixed to mainframe 10 and adapted to connect with connector line 346 on sand magazine 36 at coupling joint 348 when brought into abutting engagement upon upward movement of the sand magazine. This pressurized air is used to actuate exhaust vent valves 58 between their open position during sand charging and their closed position during blowing.

Figure 45:
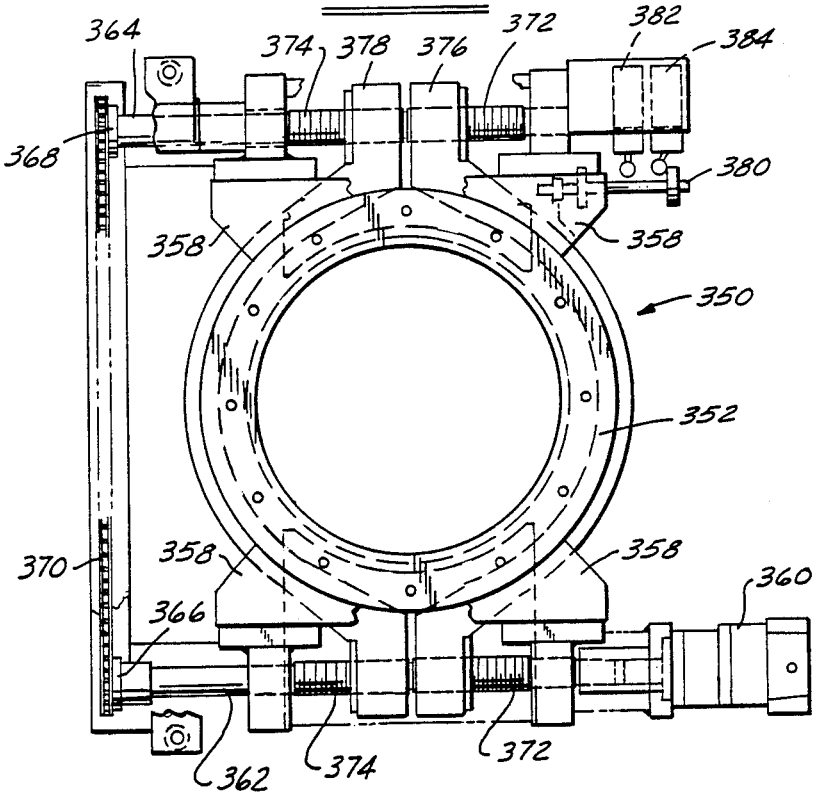
FIG. 45 is a plan view of the blow body clamping assembly.
Figure 46:
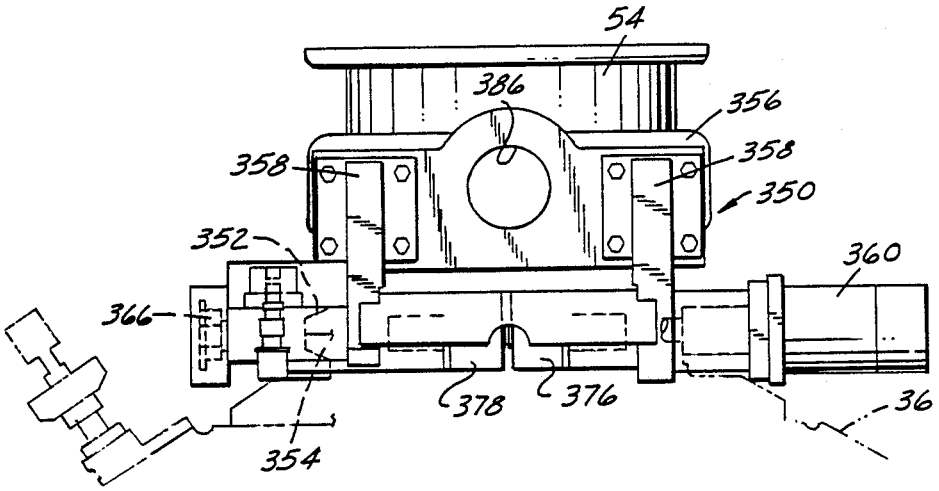
FIG. 46 is a front view of the clamping assembly of FIG. 45.

FIGS. 45 and 46 illustrate blow body clamping assembly 350 which forms a part of blow sleeve 54 and which removably clamps blow sleeve 352 to sand magazine flange 354. Assembly 350 includes annular blow body 356 from which extend four brackets 358 which in turn support reversible hydraulic drive motor 360 and rotatably mounted threaded drive shaft 362. Rotation of drive shaft 362 causes simultaneous rotation of driven shaft 364 by means of sprockets 366, 368 and connecting drive chain 370. Shafts 362 and 364 are each provided with oppositely threaded segments so that shaft rotation causes the two opposed C-clamp rings 376, 378 to move toward or away from each other, depending upon the direction of rotation.

Actuator 380 on C-clamp ring 376 is positioned to trip limit switches 382, 384 to thereby generate signals responsive to the clamped or released condition of clamping assembly 350. Air inlet 386 provides a connection point for blowing air from supply tank 62 and blow control valve 64 (see FIG. 2).

Figure 47:
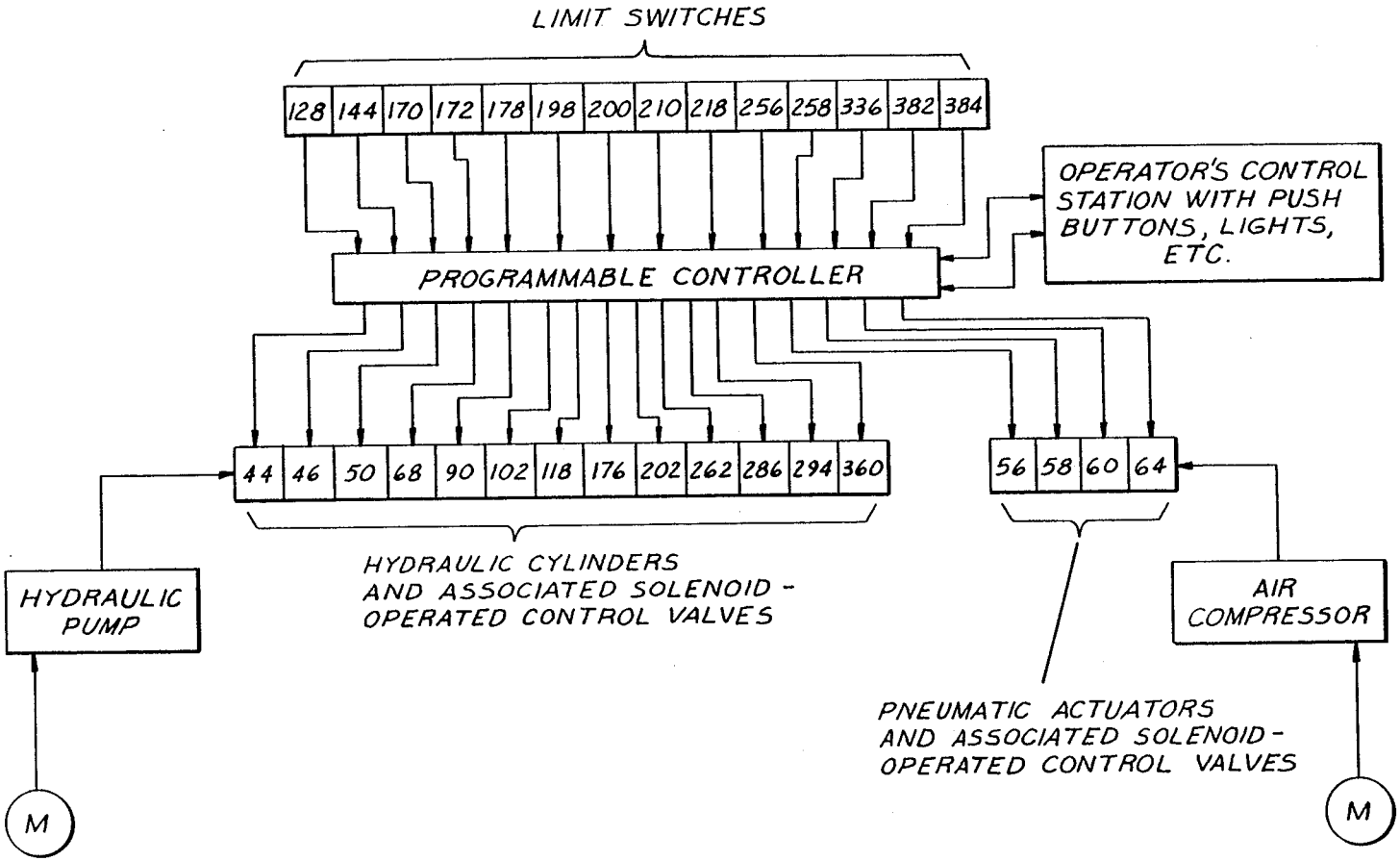
FIG. 47 is a schematic diagram of the control system.

FIG. 47 is a simplified schematic block diagram showing a control system for operating the foundry machine of the present invention. It is contemplated that the operating cycle would be controlled by a suitable programmable controller, such as manufactured by Allen-Bradley of Milwaukee, Wis.

SEQUENCE OF OPERATION

In connection with the description of the operation of the foundry machine throughout its cycle, reference should first be made to FIG. 1, and then to the simplified views of FIGS. 48–53. FIG. 1 shows all of the tooling 24 initially on tool loading table 18. The tooling includes sand magazine 36, blow plate 34, gassing manifold and ejector plate 32, cope 30, drag 28 and bottom stool 26. These elements are merely stacked on each other by appropriate nesting or other formations. They are not clamped together. The arms of core pick-off unit 100 are in their illustrated retracted position. Pivotable rails 40 on mainframe 10 are in their normal vertically oriented operative position, as illustrated in FIG. 17.

Transfer cylinder 90 is then actuated to bring gripper jaws 96 of carriage 82 into engagement with tooling coupling 98 on bottom stool 26. Next, hydraulic cylinder 118 is actuated to clamp jaws 96 onto coupling 98, and the tooling may then be transferred from tool loading and pick-off table 18 onto the aligned pivotable rails 40 of mainframe 10 (see FIGS. 4–6 and 10–14). That is the condition of the apparatus shown in solid lines in FIG. 48.

Figure 48:
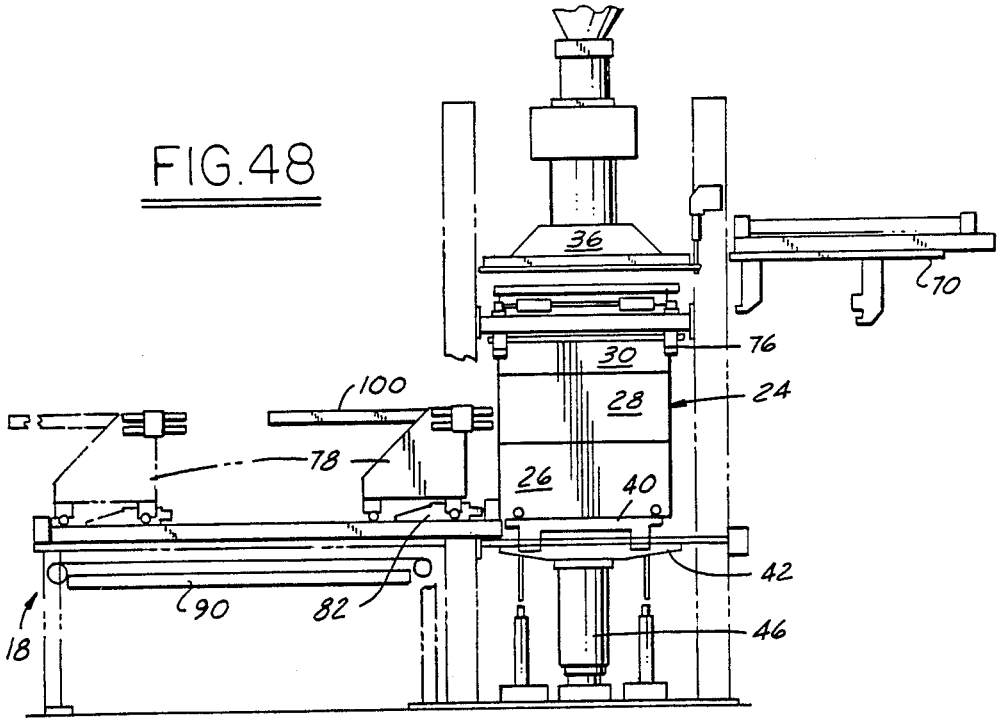

Next, gripper jaws 96 are released from tooling coupling 98 so that trolley 78 and carriage 82 may be returned to their stand-by position illustrated in phantom in FIG. 48. Table clamp cylinder 46 is then actuated to lift tooling 24 off of pivotable rails 40 and to bring tooling 24 up into engagement with blow sleeve 54. With the tooling lifted off rails 40, rotary actuator 44 is actuated to swing rails 40 outwardly to provide clearance for the table to be subsequently lowered below its starting position (see FIGS. 15–18). As clamping table 42 moves upwardly, hydraulic cylinders 202 are actuated to clamp bottom stool 26 to the table by means of clamping units 186 (see FIGS. 19–22). During this part of the cycle, cope hangers 76 are in their withdrawn position (shown in phantom in FIG. 25), to provide clearance for the vertically moving tooling. Sand magazine 36 is the clamped to blow sleeve 54 by clamping assembly 350 (see FIGS. 45–46), and blow plate 34 is clamped to sand magazine 36 by clamping units 318 (see FIGS. 38–44).

Figure 49:
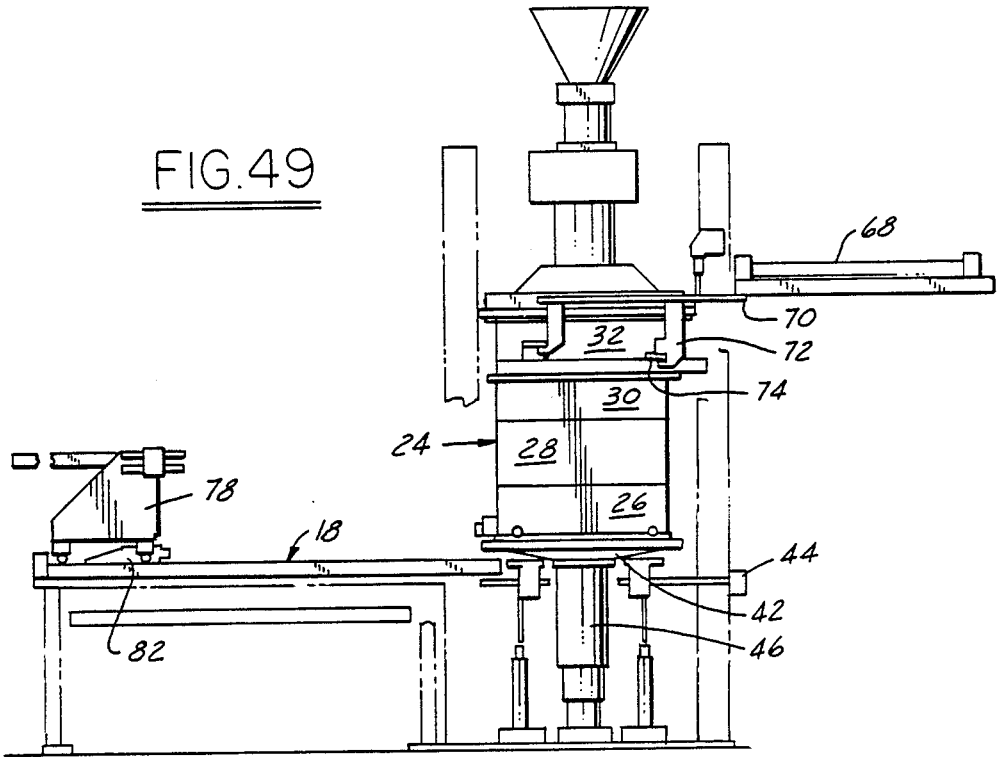

As the next step in the cycle, gassing manifold transfer carriage 70 is brought from its stand-by position shown in FIG. 48 to its clamping position shown in FIG. 49 by means of hydraulic cylinder 68. Hydraulic cylinder 286 is actuated to clamp hanger bracket 72 to retainer bracket 74 on gassing manifold 32 (see FIGS. 29 to 34). Next, cope hangers 76 are swung into their operative position by means of hydraulic cylinders 176 (see FIGS. 25–28).

Next, clamping table 42 is lowered to permit carriage 70 to move gassing manifold and top ejector plate 32 to its stand-by position. As tooling 24 moves downwardly, upper core box or cope 30 is deposited onto cope hangers 76 so that it is supported thereby. Bottom stool 26 and lower core box or drag 28 continue to move downwardly with clamping table 42, thus establishing the separation from cope 30 as shown in FIG. 50.

In the condition of FIG. 50, the machine is exactly as it would be if a completed part had been removed, and the machine is ready to start a repeat cycle to form another part. Hence, from this point on, the description of the sequence is the same for either a repetitive part-forming cycle or the formation of the first part with a newly-loaded complete set of tooling 24.

With the gassing manifold and ejector plate 32 out of the way, table 42 is once again raised, bringing drag 28 up into contact with cope 30 which is suspended on cope hangers 76. Continued upward movement of the table and tooling lifts cope 30 off of its hangers 76 and carries it upward until it engages blow plate 34. This is the condition of the apparatus illustrated in FIG. 51.

Next, sand and binder are introduced into hopper 52 and a butterfly valve (not illustrated) is opened by valve actuator 56 to admit this charge into sand magazine 36 (see FIG. 2). The butterfly valve is then closed and the sand magazine is pressurized with air from tank 62. This pressurization forces the sand from the magazine through blow plate 34 and into the core-defining cavity within the core boxes, thereby forming the core.

After the core is initially formed, table 42 is lowered a sufficient distance to permit carriage 70 to transfer gassing manifold and ejector plate 32 into position beneath blow plate 34. Table 42 is once again raised to engage the underside of the gassing manifold and ejector plate. This upward movement brings gas pipe connection 282 on the gassing manifold into sealing contact with fixed gas supply pipe 284 (see FIGS. 36–37). This is the condition illustrated in FIG. 52. Catalyzing gas is then introduced through these connections into the gassing manifold and ejector plate 32 and into the core boxes, catalyzing and hardening the newly-formed core. Purging air is then applied to the mold box cavity through the same path as the gas to remove excess gas.

During or immediately following the gassing step, cope hangers 76 are sung back into their operative position. Table 42 is lowered, and simultaneously top ejector pins 280 are actuated by hydraulic cylinder 262 (see FIG. 33) and lower ejector cylinders 50 are actuated. As table 42 starts downwardly, cope 30 engages cope hangers 76 and becomes supported thereby while table 42 and drag 28 continue down. As the two mold boxes separate, the top ejector plate is no longer constrained by the parting line pins and can move downwardly under the pressure from cylinder 262. Top ejector pins force core 388 out of the cope cavity. Meanwhile, lower ejector pin actuators 48 descent into contact with the upwardly extended rods of lower ejector cylinders 50, camming actuators 48 up into engagement with the lower ejector pin mechanism within bottom stool 26, thereby extending lower ejector pins 390 therefrom, and ejecting core 388 from drag 28. The fingers of pick-off unit 100 are then swung to their active position by rotary actuator 102 (see FIG. 6).

Figure 53:
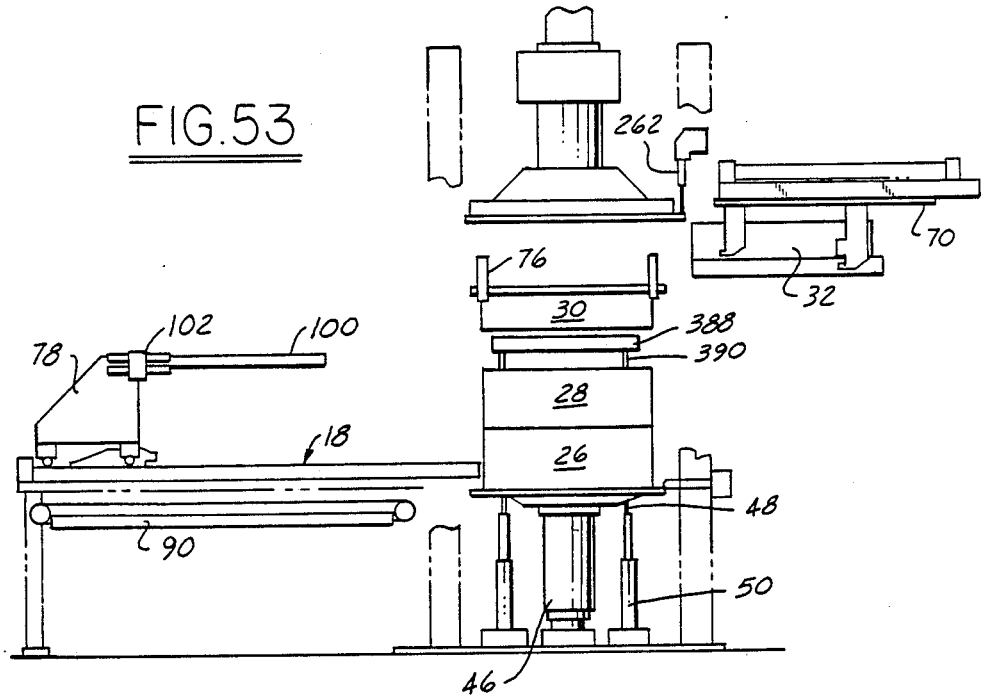

Referring next to FIG. 53, core 388 is shown supported on lower ejector pins 390, with sufficient gap above drag 28 to permit the fingers of pick-off unit 100 to enter. Carriage transfer cylinder 90 is actuated to cause carriage 82 and trolley 78 to traverse toward the right as viewed in FIG. 53 so that the pick-off fingers 100 are properly positioned beneath core 388. Lower ejector cylinders 50 are then retracted so that core 388 is gently placed onto and supported by the pick-off unit fingers. Trolley 78 is then retracted toward its stand-by position shown in FIG. 53, from which the core can be removed either manually or by robotic equipment.

It should be noted that FIG. 53 shows gassing manifold and ejector plate 32 in its retracted position. The withdrawal of that unit by carriage 70 can occur as soon as part 388 has been ejected from the molds. However, it may be preferable to defer such withdrawal until after part 388 has been removed by fingers 100, because gas vapors which may be harmful to the blow fan may be still be given off by part 388 after its ejection. The gassing manifold and ejector plate 32, if temporarily left in place on cope 30, can shield such vulnerable parts from these vapors.

If another part is to be formed using the same tooling, table 46 is then raised to carry stool 26, drag 28 and cope 30 up into engagement with blow plate 34, whereupon the cycle can be reapeated. Alternatively, if the tooling is to be removed, gassing manifold and ejector plate 32 is returned to its position beneath blow plate 34 (if it was not previously left in such position), and work table 42 is raised to carry stool 26, drag 28, cope 30 and gassing manifold and ejector plate 32 up into engagement with blow plate 34, with empty carriage 70 first being withdrawn to its stand-by position when cope 30 is raised far enough to engage and support gassing manifold and ejector plate 32. Clamps 318 and 350 (see FIGS. 45–46) are then released to disengage sand magazine 36 from blow plate 34 and from blow body 54. While work table 42 is in its raised position, pivotable rails 40 are swung back into their operative position. Table 42, with all of the tooling 24 stacked thereon, may then be lowered to bring wheels 38 of stool 26 to rest on tracks 40, whereupon carriage 82 is actuated toward the right by cylinder 90 so that gripper jaws 96 can engage tooling coupling 98 on tooling 24. Then, carriage 82 is returned to its standy-by position, bringing the tooling 24 onto tool-loading and pick-off table 18.

The invention may be further developed within the scope of the following claims. Accordingly, the foregoing specification is to be interpreted as illustrative of a single operative embodiment, rather than in a strictly limited sense.

We claim:

1. In a foundry machine for forming a part from molding material and which is characterized by a mainframe (10), a work table (42) mounted on the mainframe (10) for supporting tooling (24) including a pair of cooperating mold boxes (30,28) during portions of the machine operating cycle, each of the mold boxes (30, 28) having a cavity therein to jointly define a cavity in which the part is to be formed, table transfer means (46) mounted on the mainframe (10) for transferring the work table (42) between various loading, part-forming and part-removing positions, part-ejecting means (50, 390, 262,280) mounted on said tooling (24) and on said mainframe (10) for ejecting a finished part (388) from the mold boxes (30, 28), and supply means (52) mounted on the mainframe (10) for supplying molding material to the mold boxes (28, 30), the improved apparatus for loading and unloading tooling from a foundry machine comprising:

tooling support means (40, 76) mounted on the mainframe (10) for supporting at least portions of the tooling (24) during portions of the machine operating cycle;

said tooling support means (40, 76) including mold box separating means (76) for separating the mold box pair (28, 30) from each other following formation of the part (388) within the mold box cavities;

a stationary tooling-loading table (18) adjacent to the mainframe (10) and work table (42);

tooling transfer means (82) movably mounted on said tooling-loading table (18) for transferring tooling (24) to and from said tooling support means (40);

part-removal means (78, 100) for removing a finished part (388) from the part-ejecting means (390); and motive means (90) mounted on said tooling-loading table (18) for producing and controlling powered movement of said tooling transfer means (82) and said part-removal means (78, 100);

said tooling transfer means (82) including a first pair of rails (22) for supporting and guiding the tooling (24) while it is on said tooling-loading table (18), said tooling support means (40, 76) including a second pair of rails (40) aligned with said first pair of rails (22) for supporting the tooling (24) during said transfer between said tooling-loading table (18) and said tooling support means (40).

2. The foundry machine of claim 1 wherein said rails of said second pair of rails (40) are spaced apart sufficiently to permit the work table (42) to rise between them and to lift tooling (24) therefrom.

3. The foundry machine of claim 1 which further comprises rail shifting means (44) mounted on the mainframe (10) for selectively shifting the position of said second pair of rails (40) out of the path of movement of the tooling (24) when the tooling is carried by the work table (42).

4. The foundry machine of claim 3 wherein said second pair of rails (40) is pivotally mounted on said mainframe (10), whereby said rail shifting means (44) cause said second pair of rails (40) to pivot laterally away from each other to permit the tooling (24) to move between them while supported on the work table (42).

5. The foundry machine of claim 1 wherein the tooling (24) carries rotatably mounted wheels (38) adapted to roll along said first and second pairs of rails (22, 40).

6. The foundry machine of claim 1 wherein said tooling transfer means (82) comprises power-driven gripper means (96) for gripping a cooperating formation (98) on said tooling (24) to push the tooling (24) along said first pair of rails (22) and onto said second pair of rails (40) during a tool-loading portion of the machine operating cycle, and to pull the tooling (24) from said second pair of rails (40) onto said first pair of rails (22) during a tool unloading portion of the machine operating cycle.

7. The foundry machine of claim 1 wherein said part-removal means (78, 100) is mounted for powered movement on said first pair of rails (22) between a stand-by position remote from the mainframe (10) and an operative position adjacent the mainframe (10) where it engages an ejected finished part (388) and conveys such part away from the mainframe (10) and toward said stand-by position of said part-removal means (78, 100).

8. The foundry machine of claim 7 wherein said part-removal means (78, 100) and said tooling transfer means (82) are connected together (96, 98) for movement along said first pair of rails (22) under the control of said motive means (90).

9. The foundry machine of claim 8 wherein said tooling transfer means (82) is mounted on said first pair of rails (22) at a location between said part-removal means (78, 100) and said mainframe (10), and wherein said part-removal means (78, 100) includes part-receiving means (100) which are movably mounted on said part-removal means (78) between a retracted stand-by position in which they do not interfere with tooling (24) which may be positioned on said tool-loading table and an extended operative position in which they are capable of reaching an ejected finished part (388) while the tooling (24) remains supported by the mainframe (10).

10. The foundry machine of claim 1 which further comprises tool clamping means (186, 202) mounted on the work table 942) for selectively clamping the tooling (24) to the table (42).

11. In a foundry machine for forming a part from molding material and which is characterized by a mainframe (10), a work table (42) mounted on the mainframe (10) for supporting tooling (24) including a pair of cooperating upper and lower mold boxes (30, 28) during portions of the machine operating cycle, each of the mold boxes (30, 28) having a cavity therein to jointly define a cavity in which the part is to be formed, table transfer means (46) mounted on the mainframe (10) for transferring the work table (42) between various loading, part-forming and part-removing positions, part-ejecting means (50), 390, 262, 280) mounted on said tooling (24) and on said mainframe (10) for ejecting a finished part (388) from the mold boxes (30, 28) , and supply means (52) mounted on the mainframe (10) for supplying molding material to the mold boxes (28, 30), the improved apparatus for loading and unloading tooling from a foundry machine comprising:

tooling support means (40, 76) mounted on the mainframe (10) for supporting at least portions of the tooling (24) during portions of the machine operating cycle;

said tooling support means including mold box separating means (76) for separating the mold box pair (28,30) from each other following formation of the part (388) within the mold box cavities, the part-ejecting means (50, 390) functioning to eject a finished part (388) from the separated mold boxes (28, 30) and to support the ejected part (388) in a spaced relationship from the mold boxes (28, 30);

a stationary tooling-loading table (18) adjacent to the mainframe (10) and work table (42);

tooling transfer means (82) movably mounted on said tooling-loading table (18) for transferring tooling (24) to and from said tooling support means (40);

part-removal means (78, 100) for removing a finished part (388) from the part-ejecting means (390), said part-removal means (78, 100) being mounted for powered movement on said tooling-loading table (18) between a stand-by position and an operative position where it engages an ejected finished part (388), removes such part from the part-ejecting means (390) while the tooling (24) remains supported by the mainframe (10), and conveys the part (388) away from the mainframe (10); and motive means (90) mounted on said tooling-loading table (18) for producing and controlling powered movement of said tooling transfer means (82) and said part-removal means (78, 100).

12. The foundry machine of claim 11 wherein said part-removal means (78, 100) comprises fingers (100) which are adapted to extend into said space between the ejected part (388) and the lower mold box (28), and part-transferring means (50) mounted on one of said mainframe (10) and said tooling-loading table (42) for transferring said ejected part (388) from said part-ejecting means (390) to said part-removal means (100) by relative vertical movement therebetween.

13. The foundry machine of claim 12 wherein said part-transferring means (50) comprises a lower part-ejecting means (50, 48, 390), and wherein the ejected part (388) is transferred onto said part-removal fingers (100) by downward movement of said lower part-ejecting means (50, 48, 390) after said fingers (100) have been extended into said space.

14. The foundry machine of claim 11 wherein said part-removal means (78, 100) and said tooling transfer means (82) are connected together (96, 98) for movement along the tooling-loading table (18) under the control of said motive means (90).

15. The foundry machine of claim 14 wherein said tooling transfer means (82) is mounted between said part-removal means (78, 100) and said mainframe (10), and wherein said part-removal means (78, 100) comprises fingers (100) which are movably mounted on said part removal means (78) for movement between a retracted stand-by position in which they do not interfere with tooling (24) which may be positioned on said tooling-loading table (18) and an extended operative position in which they are capable of reaching an ejected part (388) which is supported on the part-ejecting means (390) while the tooling (24) remains supported by the mainframe 10.

16. The foundry machine of claim 11 wherein said tooling support means (40, 76) include upper mold box support means (76) mounted on the mainframe (10) for supporting the upper mold box (30) independently of the lower mold box (28) at predetermined times in the machine-operating cycle.

17. In a foundry machine for forming a part from molding material and which is characterized by a mainframe (10), a work table (42) mounted on the mainframe

(10) for supporting tooling (24) including a pair of upper and lower mold boxes (30), (28) during portions of the machine operating cycle, each of the mold boxes (30), (28) having a cavity therein to jointly define a cavity in which the part is to be formed, table transfer means (46) mounted on the mainframe (10) for transferring the work table (42) between various loading, part-forming and part-removing positions, part-ejecting means (50, 390, 262, 280) mounted on said tooling (24) and on said mainframe (10) for ejecting a finished part (388) from the mold boxes (30), (28), and supply means (52) mounted on the mainframe (10) for supplying molding material to the mold boxes (28, 30), the improved method for loading and unloading tooling from a foundry machine comprising:

placing the tooling (24) initially on a tooling-loading table (18) adjacent to the mainframe (10) and work table (42);

transferring the tooling (24) from said tooling-loading table (18) to tool-receiving means (40) on the mainframe (10) while continuously supporting the tooling (24) first by said tooling-loading table (18) and then by said tooling-receiving means (40);

bringing the work table (42) into engagement with the tooling (24) and raising the tooling off said tooling-receiving means (40) with the work table (42);

shifting the tooling (24) to a part-forming position while supporting the tooling (24) on the work table (42);

separating the mold boxes (28, 30) following formation of the part (388);

ejecting the finished part (388) from the mold boxes (28, 30) while continuing to support it with the tooling (24, 390);

bringing a part-removal means (78, 100) into a space beneath the ejected but still tooling-supported part (388) while supporting said part-removal means (78, 100) on said tooling-loading table (42);

lowering the part (388) onto said part-removal means (100);

and removing the part (388) from the mainframe (10) to said tooling-loading table (42) while supporting the part (388) by said tooling loading table (42).

18. The method of claim 17 which further comprises:

lowering the work table-supported tooling (24) onto said tooling-receiving means (100) following the part-removal step;

and transferring the tooling (24) from said tooling-receiving means (40) to said tooling-loading table (42) while continuously supporting the tooling (24) first by said tooling-receiving means (40) and then by said tooling loading table (42).

19. The method of claim 17 wherein the tooling (24) which is loaded into the foundry machine according to the recited steps includes a blow plate (34).

20. The method of claim 17 wherein the tooling (24) which is loaded into the foundry machine according to the recited steps includes a blow plate (34) and a sand magazine (36).

21. The method of claim 17 wherein the tooling (24) which is loaded into the foundry machine according to the recited steps includes a gassing manifold (32) and an upper part ejector means (280).

22. The method of claim 17 wherein the tooling (24) which is loaded into the foundry machine according the recited steps includes a gassing manifold (32), an upper part ejector means (280), a blow plate (34) and a sand magazine (36).

23. The method of claim 17 which further comprises the step of clamping lower portions of the tooling (24) onto the work table (42) after the work table has raised the tooling off said tooling-receiving means (40).

24. An improved foundry machine for forming a part from molding material, and of the type including the combination of a mainframe (10), tooling support means (42, 46, 76) on said mainframe (10) for shiftably supporting tooling including a pair of mold portions (28, 30) cooperating to form the part, means (280) for ejecting the part from the tooling and means (186) for releasably holding the tooling on the combination of the mainframe (10) and the tooling support means (42,46), wherein the improvement comprises:

a support table (18) adjacent to said mainframe (10) and said tooling support means (42, 46);

carriage means (78, 82);

means (82, 22, 88) for mounting said carriage means (78, 82) for reciprocal movement on said support table (18) between a first position spaced from said mainframe (10) and a second position adjacent said mainframe (10);

means (38,22) for mounting said tooling for travelling on said support table (18) when said tooling is released from the combination of said mainframe (10) and said tooling supporting means (42, 46);

means (96,98) for selectively coupling said tooling with said carriage means (78, 82) when said tooling is mounted for travelling on said support table (18);

power operated means for driving said carriage means (78, 82) between said first and second positions thereof, in a first mode of operation in which said carriage means (28,82) transports said tooling along said support table (18) and a second mode of operation in which said carriage means (78,82) transports said part away from said tooling; and part removal means (100) for removing a part formed by said tooling, said part removal means (100) being shiftably mounted on said carriage means (22,82, 88) between a standby position when said carriage means (28,82) is driven in said first operating mode thereof and an operating position for removing said part from said tooling when said carriage means (28, 82) is driven in said second operating mode thereof.

25. The improvement of claim 24, wherein said carriage means (78, 82) includes a first portion (78) having said part removal means (100) mounted thereon, and a second portion (82) having at least a portion (96) of said coupling means (96, 98) mounted thereon, and means (84, 86) for selectively coupling said first portion (78) with said second portion (82) to allow simultaneous or independent movement of said first and second portions.

26. the improvement of claim 25, wherein said first portion (78) includes a trolley and said carriage mounting means includes rail means (22) on which said trolley is mounted for guided movement therealong.

27. The improvement of claim 25, wherein said second portion (82) includes a carriage (78) and said carriage mounting means includes at least one guide rail (114) upon which said carriage (78) is mounted.

28. The improvement of claim 24, including power operated motor means (102) carried by said carriage means (78, 82) for shifting said part removal means (100) between said standby and operating positions thereof.

29. The improvement of claim 25, wherein:

said carriage mounting means (22, 82, 88) includes rail means (22), said carriage means (78, 82) includes first wheel means (80) mounted on said rail means (22), and said tooling includes second wheel means (38) mounted on said rail means (22).

* * * * *